US011575195B2

(12) United States Patent
Dembinski et al.

(10) Patent No.: US 11,575,195 B2
(45) Date of Patent: Feb. 7, 2023

(54) MECHANICAL TILT MOUNTING SYSTEM FOR A BASE STATION ANTENNA

(71) Applicant: CommScope Technologies LLC, Hickory, NC (US)

(72) Inventors: Michel Dembinski, Dallas, TX (US); Samantha L. Merta, Richardson, TX (US); Paul D. Everest, Flower Mound, TX (US); Eileen Holland, Chicago, IL (US); Steven Rogers, Garland, TX (US); Khanh Duy Tran, Rowlett, TX (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/108,655

(22) Filed: Dec. 1, 2020

(65) Prior Publication Data

US 2021/0175598 A1 Jun. 10, 2021

Related U.S. Application Data

(60) Provisional application No. 62/988,561, filed on Mar. 12, 2020, provisional application No. 62/943,370, filed on Dec. 4, 2019.

(51) Int. Cl.
*H01Q 1/24* (2006.01)
*H01Q 1/08* (2006.01)
(Continued)

(52) U.S. Cl.
CPC ..... *H01Q 1/246* (2013.01); *H01Q 1/084* (2013.01); *H01Q 1/125* (2013.01);
(Continued)

(58) Field of Classification Search
CPC ..... H01Q 1/084; H01Q 1/1242; H01Q 1/125; H01Q 1/246; H01Q 1/48; H01Q 1/1228; H01Q 1/1264; H01Q 1/12; H01Q 1/42; H01Q 3/02; H01Q 3/04; H01Q 3/06; H01Q 3/08
See application file for complete search history.

(56) References Cited

U.S. PATENT DOCUMENTS 5,440,318 A * 8/1995 Butland ..... H01Q 21/08 343/822
2007/0152124 A1* 7/2007 Staney ..... F16M 11/10 248/371
2014/0103184 A1* 4/2014 Asrokin ..... H01Q 3/06 248/514

FOREIGN PATENT DOCUMENTS

WO WO2020/116802 A1 * 6/2020
WO WO2020/197251 A1 * 10/2020

OTHER PUBLICATIONS

U.S. Appl. No. 62/775,524, filed Dec. 5, 2018.
Communication Components Inc. , "Antennas", Data Sheet MBK-01—Revision 1.0, Feb. 11, 2016, 3 pp.

* cited by examiner

*Primary Examiner* — Robert Karacsony
(74) *Attorney, Agent, or Firm* — Myers Bigel, P.A.

(57) ABSTRACT

A mechanical tilt mounting system for a base station antenna includes a fixed pivot that connects the antenna to a support structure. The antenna is rotatable about the fixed pivot. An adjustable control arm has a first end connected to the antenna and a second end connected to the support structure. Extension and contraction of the adjustable arm rotates the antenna about the fixed pivot to change the angle of inclination of the antenna.

17 Claims, 18 Drawing Sheets

(51) Int. Cl.
*H01Q 1/12* (2006.01)
*H01Q 1/48* (2006.01)

(52) U.S. Cl.
CPC ..... *H01Q 1/1228* (2013.01); *H01Q 1/1242* (2013.01); *H01Q 1/1264* (2013.01); *H01Q 1/48* (2013.01)

MECHANICAL TILT MOUNTING SYSTEM FOR A BASE STATION ANTENNA

CROSS-REFERENCE TO RELATED APPLICATION

The present application claims priority under 35 U.S.C. § 119 to U.S. Provisional Application Ser. No. 62/943,370, filed Dec. 4, 2019, and to U.S. Provisional Application Ser. No. 62/988,561, filed Mar. 12, 2020 the entire content of each are incorporated herein by reference.

BACKGROUND

The present invention generally relates to radio communications and, more particularly, to base station antennas for cellular communications systems.

Cellular communications systems are well known in the art. In a cellular communications system, a geographic area is divided into a series of regions that are referred to as "cells," and each cell is served by a base station. The base station may include one or more base station antennas that are configured to provide two-way radio frequency ("RF") communications with mobile subscribers that are geographically positioned within the cells served by the base station. Typically, the antennas are mounted on a tower or other raised structure, with the radiation beam(s) that are generated by each antenna directed outwardly to serve the respective coverage area.

Base station antennas are directional devices that can concentrate the RF energy that is transmitted in or received from certain directions. The "gain" of a base station antenna in a given direction is a measure of the ability of the antenna to concentrate the RF energy in that direction. The "radiation pattern" of a base station antenna—which is also referred to as an "antenna beam"—is a compilation of the gain of the antenna across all different directions. Each antenna beam may be designed to service a pre-defined coverage area such as the cell or a portion thereof, referred to as a "sector." Each antenna beam may be designed to have minimum gain levels throughout the pre-defined coverage area, and to have much lower gain levels outside of the coverage area to reduce interference between neighboring cells/sectors.

Base station antennas typically comprise an array of radiating elements such as patch, dipole or crossed dipole radiating elements. Many base station antennas now include multiple arrays of radiating elements, each of which generates its own antenna beam. Many modern base station antennas now have antenna beams that can be electronically reconfigured from a remote location. The most common way in which an antenna beam may be reconfigured electronically is to change the pointing direction of the antenna beam (i.e., the direction in which the antenna beam has the highest gain), which is referred to as electronically "steering" the antenna beam.

In addition to the electronic steering of the antenna beam, base station antennas may be mechanically steered vertically in the elevation plane. To mechanically steer the antenna beam, the antenna is physically tilted relative to a vertical plane to direct irradiation further down (downtilt) or further up (uptilt) thereby concentrating the energy in the new desired direction. Mechanical tilt is used to reduce interference and/or coverage in a specific area and to concentrate coverage in a designated area. Typically, the antennas are tilted in a downward direction and the tilting of the antenna is used to adjust the downtilt.

In a typical installation, the antenna is mounted to a support structure, such as a pole, by a pair of brackets. The mechanical tilt of the antenna is typically performed by pivoting the antenna about a horizontal axis defined by a first bracket using a second adjustable bracket. One typical adjustable bracket comprises a scissor-style bracket that is adjusted by loosening and removing a number of screws, re-aligning the bracket and reinstalling the screws. One problem with such a bracket is that the loose screw components may be dropped or misplaced. Moreover, the removal of the screws adds complexity to the tilt adjustment procedure. Issues may also result in the proper alignment of the holes that receive the removed screws. The scissor action of the bracket also creates a potential pinch point for the installer. All of these issues are exacerbated when it is considered that the installation and adjustment of the antenna is often performed on antenna towers that are exposed to the elements and at significant elevations.

An improved mechanical tilt mounting system for base station antennas is desired.

SUMMARY

In some embodiments, a mechanical tilt mounting system for a base station antenna, comprises a fixed pivot configured to connect the antenna to a support structure. The antenna is rotatable about the fixed pivot to change the angle of inclination of the antenna. An adjustable control arm comprises a turnbuckle assembly having a first end connected to the antenna and a second end configured to connect to a support structure such that adjustment of the turnbuckle assembly rotates the antenna about the fixed pivot.

The first end of the adjustable control arm may comprise a first lockable pivot and the second end of the adjustable control arm may comprise a second lockable pivot. The first lockable pivot and the second lockable pivot may each comprise a pivot pin that is secured by a mating member that may be tightened to fix the position of the adjustable control arm relative to the support structure and to the antenna and loosened to allow relative pivoting motion between the adjustable control arm and the support structure and the antenna about the first pivot pin and the second pivot pin. The turnbuckle assembly may comprise a first threaded member defining the first end and a second threaded member defining the second end, wherein one of the first threaded member and the second threaded member is a left-hand thread and the other one of the first threaded member and the second threaded member is a right-hand thread. The first threaded member and the second threaded member may threadably engage a frame such that rotation of the frame causes both of the first threaded member and the second threaded member to be simultaneously extended from or retracted into the frame. An expandable and contractable slide arm may be provided having a first end connected to the antenna and a second end configured to connect to a support structure, where the first end of the slide arm may comprise a third lockable pivot and the second end of the slide arm may comprise a fourth lockable pivot. The slide arm may comprise a first arm section and a second arm section where the first arm section and the second arm section may be slidably mounted relative to one another such that the position of the first arm section relative to the second arm section is adjustable to set the length of the slide arm. A slide lock may releasably secure the position of the first arm section relative to the second arm section arm section to thereby fix the length of the slide arm. The mechanical tilt mounting system for a base station antenna according to claim 1, further comprising a second adjustable control arm comprising a second turnbuckle assembly having a first end connected to the antenna and a second end configured to connect to the support structure.

In some embodiments, a method of adjusting the mechanical tilt of a base station antenna, comprises rotating a frame of a turnbuckle assembly to increase or decrease the length of the turnbuckle assembly to rotate the base station antenna about a fixed pivot axis; and locking the position of the turnbuckle assembly relative to the base station antenna. The step of locking the position of the turnbuckle assembly relative to the base station antenna may comprise locking a pivot between the turnbuckle assembly and the antenna.

In some embodiments, a mechanical tilt mounting system for a base station antenna comprises a fixed pivot configured to connect the antenna to a support structure where the antenna is rotatable about the fixed pivot to change the angle of inclination of the antenna. An adjustable mount comprises an adjustable arm having an effective length where the adjustable arm comprises a first member defining a first pivot pivotably connected to the antenna and a second member defining a second pivot pivotably connected to a support structure. The first member is pivotably and translationally connected to the second member. A linear drive moves the first member relative to the second member to change the effective length.

The first member may be pivotably connected to the antenna at a first axis of rotation and the second member may be pivotably connected to a support structure at a second axis of rotation where the effective length may be a distance between the first axis of rotation and the second axis of rotation such that movement of the first member relative to the second member changes the distance. The first member may be mounted to the antenna by a first lockable pivot that forms the first axis of rotation and the second member may be mounted to the first member by a second lockable pivot that forms the second axis of rotation. The linear drive may comprise a lead screw that is mounted for rotational movement along its longitudinal axis where the lead screw is fixed to one of the first member or the second member and threadably engages a follower that is secured to the other one of the first member and the second member. The first member may comprise an elongated slot that receives the second lockable pivot and the lead screw may extend parallel to the elongated slot. The rotation of the lead screw may cause the first member to extend away from or retract toward the second member to change the effective length of the adjustable arm. The lead screw may comprise a connector configured to be engaged by a power driver. The first lockable pivot and the second lockable pivot may each comprise a pivot pin that is secured by a mating member that may be tightened to fix the position of the first member relative to the antenna and to the second member and loosened to allow relative pivoting motion between the first member and the antenna and the second member.

In some embodiments, a method of operating a mechanical tilt mounting system for a base station antenna that comprises a fixed pivot configured to connect the antenna to a support structure, an adjustable mount comprising an adjustable arm having a first end pivotably connected to the antenna at a first lockable pivot and a second end pivotably connected to a support structure at a second lockable pivot, wherein the adjustable arm comprises a first member defining the first pivot and a second member defining the second pivot where the distance between the first member and the second member defines an effective length of the adjustable arm, the first member being pivotably and translationally connected to the second member, and a linear drive for moving the first member relative to the second member. The method comprises unlocking the first lockable pivot; unlocking the second lockable pivot; actuating the linear drive to move the first member relative to the second member to change the effective length of the adjustable arm. The linear drive may comprise a lead screw and actuating the linear drive comprises engaging the lead screw with a power driver.

DETAILED DESCRIPTION

Figure 1A:
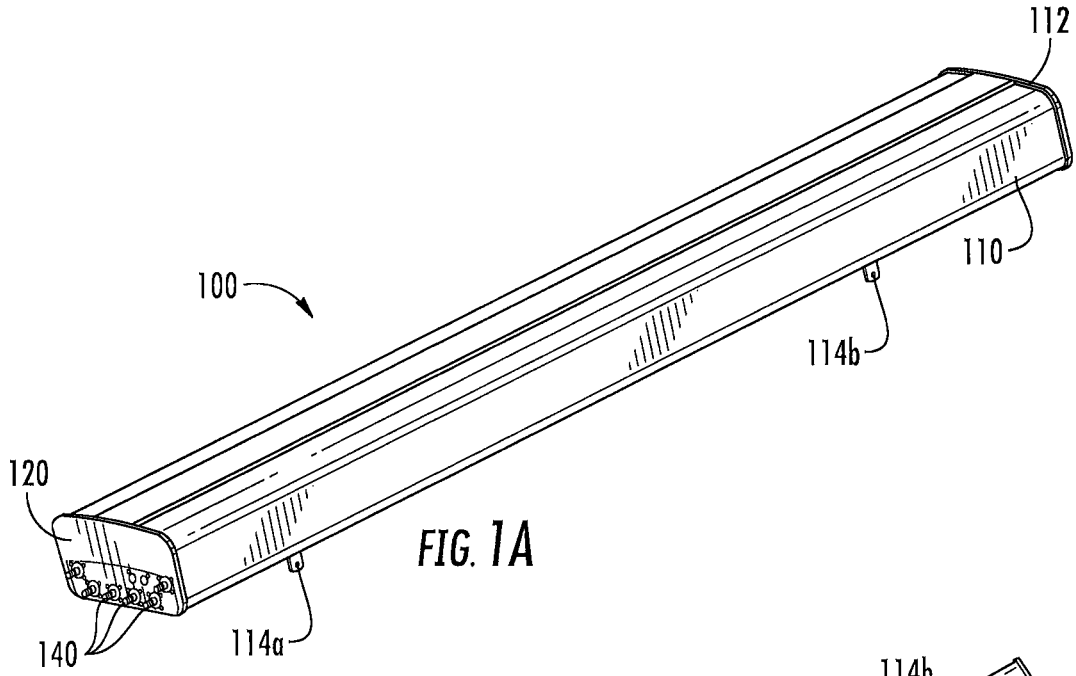
FIGS. 1A-1F are a front perspective view, a back perspective view, a front view, a side view, a back view, and an end view, respectively, of an exemplary base station antenna according to embodiments of the present invention.
Figure 1B:
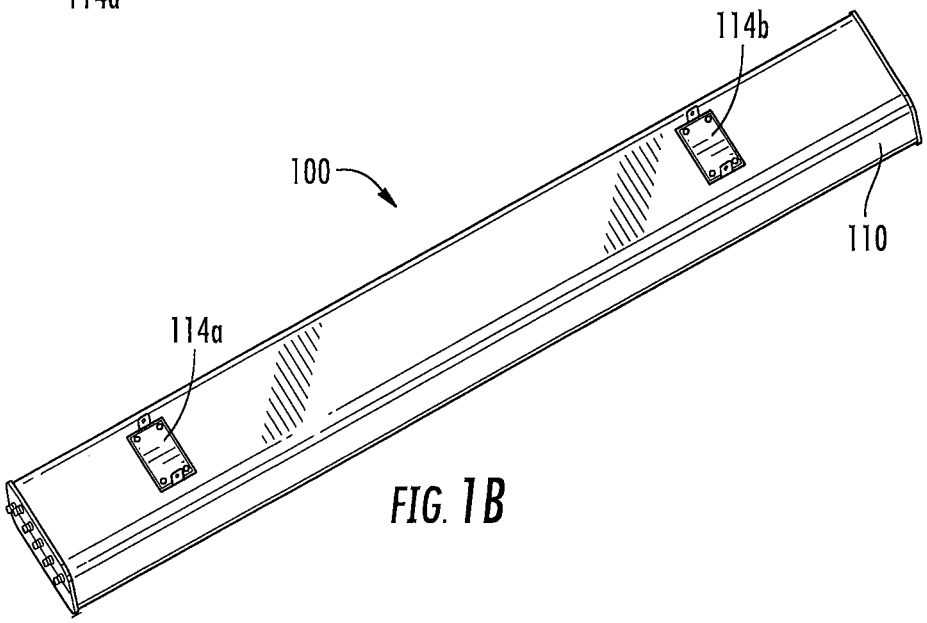
Figure 1C:
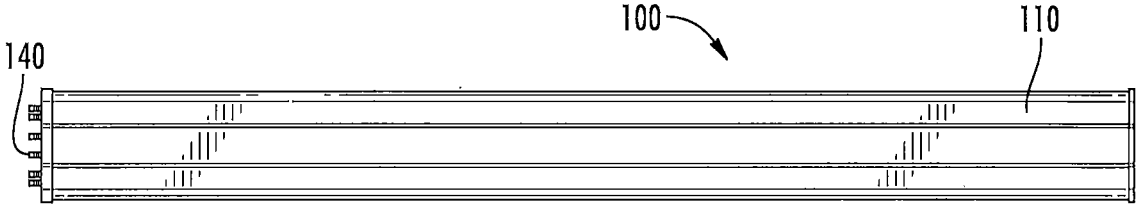
Figure 1D:
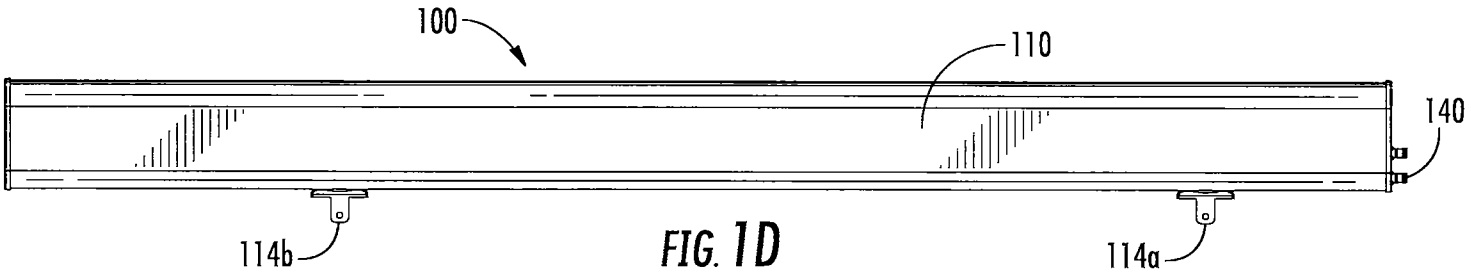
Figure 1E:
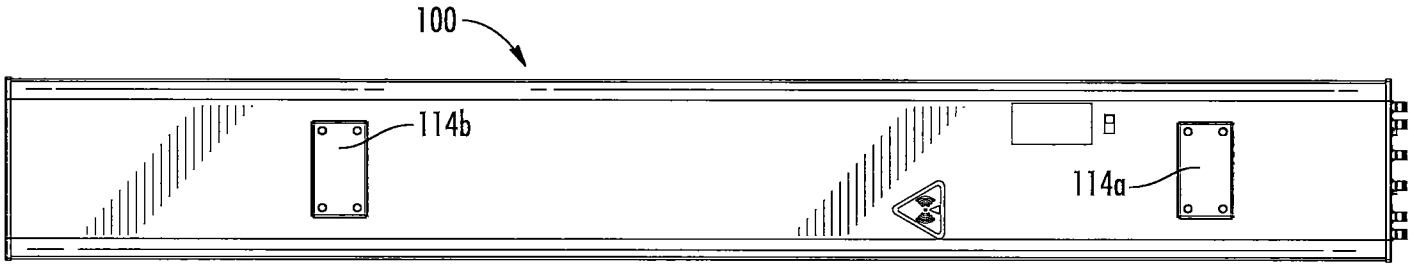
Figure 1F:
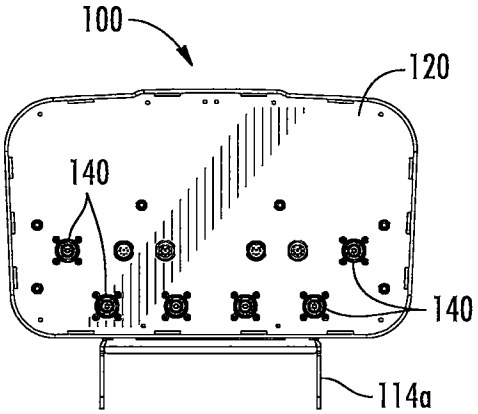

Pursuant to embodiments of the present invention, a mechanical tilt mounting system for an antenna is provided. The mechanical tilt mounting system is easier to adjust than existing systems, eliminates loose components, reduces the number of components that the installer needs to loosen, eliminates alignment issues and eliminates scissor pinch points.

Embodiments of the present invention will now be described in further detail with reference to the attached figures. FIGS. 1A-1F illustrate one embodiment of a base station antenna 100 that may utilize the mechanical tilt mounting system according to certain embodiments of the present invention. While a particular embodiment of an antenna is described in detail herein, the mechanical tilt mounting system of the invention may be used to provide mechanical tilt with virtually any type of antenna and the mechanical tilt mounting system is not limited to use with the antenna structure as specifically described herein.

As shown in FIGS. 1A-1F, the antenna 100 is an elongated structure and has a generally rectangular shape. In an example embodiment, the width and depth of the antenna 100 may be fixed, while the length of the antenna 100 may be variable. The antenna 100 includes a radome 110 and a top end cap 112. A pair of mounting brackets 114*a*, 114*b* are provided on the rear side of the radome 110 which may be used to mount the antenna 100 onto an antenna mount on, for example, an antenna tower, as will hereinafter be explained. The antenna 100 also includes a bottom end cap 120 which includes a plurality of connectors 140 mounted therein. The antenna 100 is typically mounted in a generally vertical configuration (i.e., the long side of the antenna 100 extends along a vertical axis with respect to the earth).

Figure 2A:
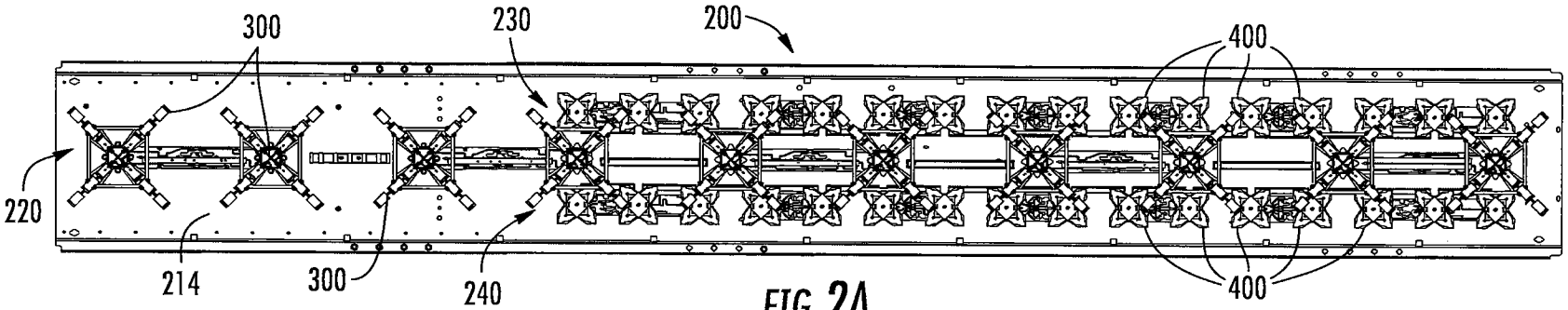
FIGS. 2A-2C are a front view, a side view, and a back view, respectively, of an embodiment of an exemplary base station antenna of FIGS. 1A-1F with the radome thereof removed.
Figure 2B:
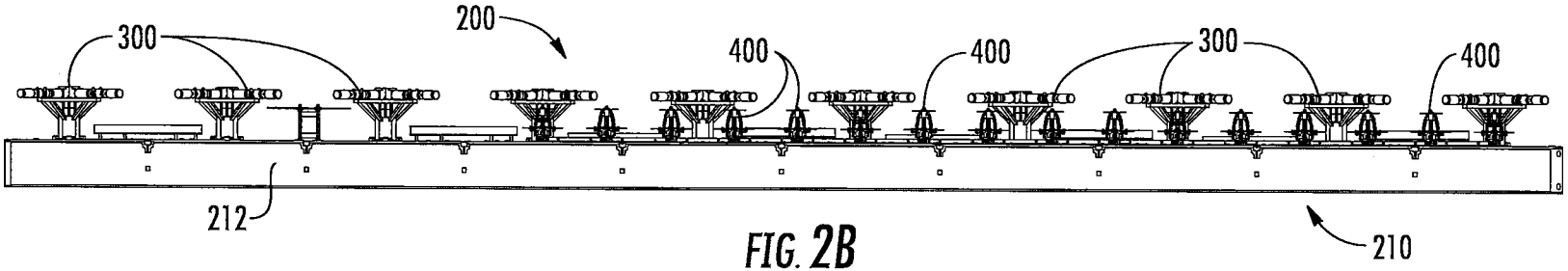
Figure 2C:
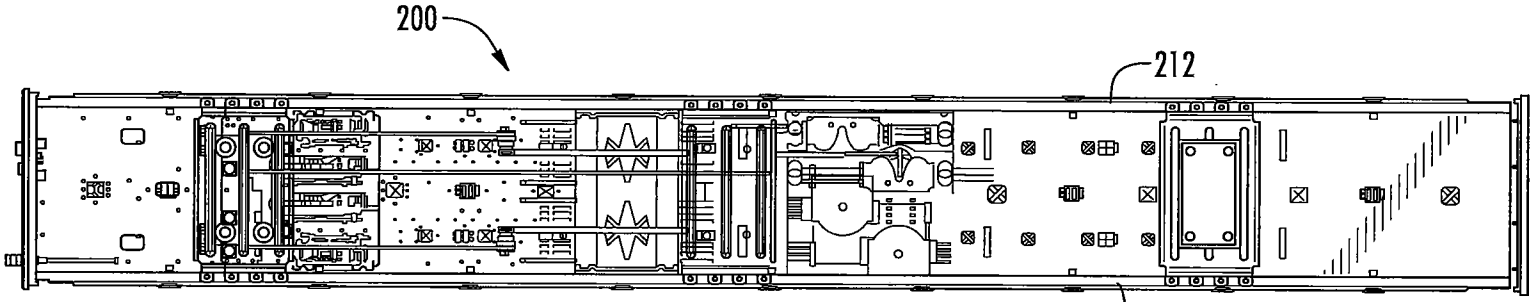

As shown in FIGS. 2A-2C, the antenna 100 includes an antenna assembly 200 that is slidably inserted into the radome 110 through the bottom opening 113 (see FIG. 3A) thereof. The antenna assembly 200 includes a ground plane structure 210 that has sidewalls 212, which here include RF choke sections, and a reflector surface 214. Various mechanical and electronic components of the antenna are mounted to the ground plane structure 210. These electronic and mechanical components include, among other things, phase shifters, remote electronic tilt ("RET") units, mechanical linkages, diplexers, and the like. The ground plane structure 210 may comprise the back portion of the antenna assembly 200.

A plurality of radiating elements 300, 400 are mounted on the reflector surface 214 of the ground plane structure 210. The radiating elements include low band radiating elements 300 and high band radiating elements 400. The low band radiating elements 300 are mounted along a first vertical axis and may extend along the full length of the antenna 100 in some embodiments. The column of low band radiating elements 300 form an array 220 of low band radiating elements. The high band radiating elements 400 may be divided into two groups that are mounted along respective second and third vertical axes with the first vertical axis (and the low band radiating elements 300) extending therebetween. The high band radiating elements 400 may not extend the full length of the antenna 100 in some embodiments as shown. In some instances, multiple high band arrays can be arranged in the second and/or third vertical axes. The first column of high band radiating elements 400 form a first array 230 of high band radiating elements, and the second column of high band radiating elements 400 form a second array 240 of high band radiating elements. The low band radiating elements 300 may be configured to transmit and receive signals in a first frequency band. In some embodiments, the first frequency band may be a wide band and may comprise the 694-960 MHz frequency range. The high band radiating elements 400 may be configured to transmit and receive signals in a second frequency band. In some embodiments, the second frequency band may also be a wide band and may comprise the 1.695-2.690 GHz frequency range.

Figure 3A:
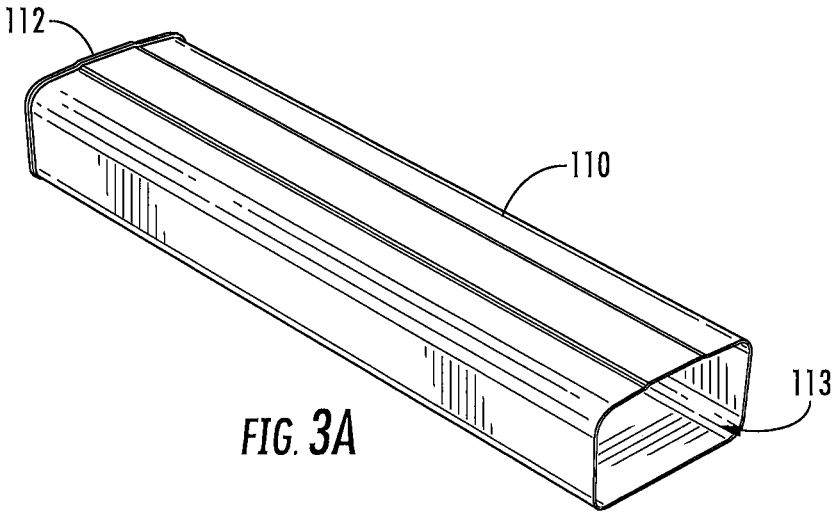
FIG. 3A is a perspective view of the radome of FIGS. 1A-1F with the antenna structure removed.
Figure 3B:
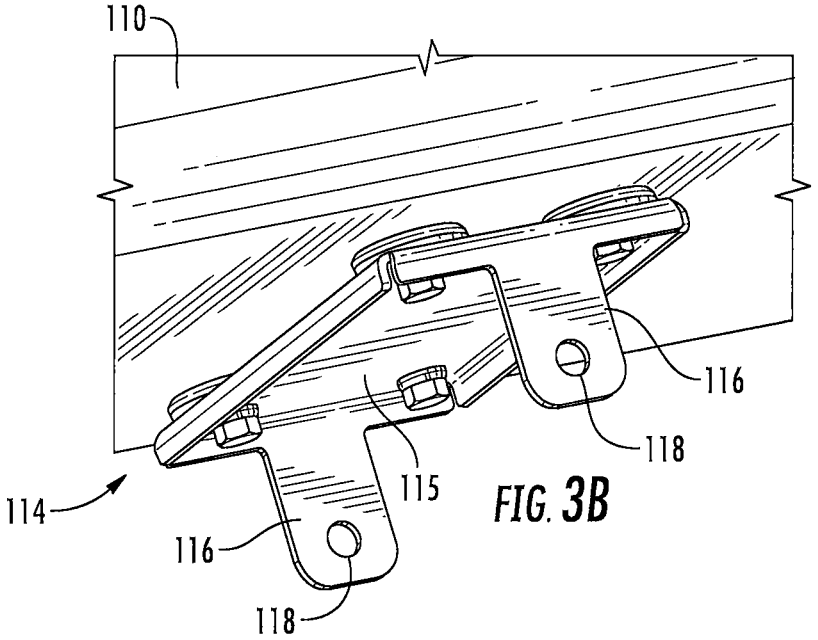
FIG. 3B is an enlarged perspective view of a portion of the back of the radome of FIGS. 1A-1F that illustrates a mounting plate assembly thereof.
Figure 3C:
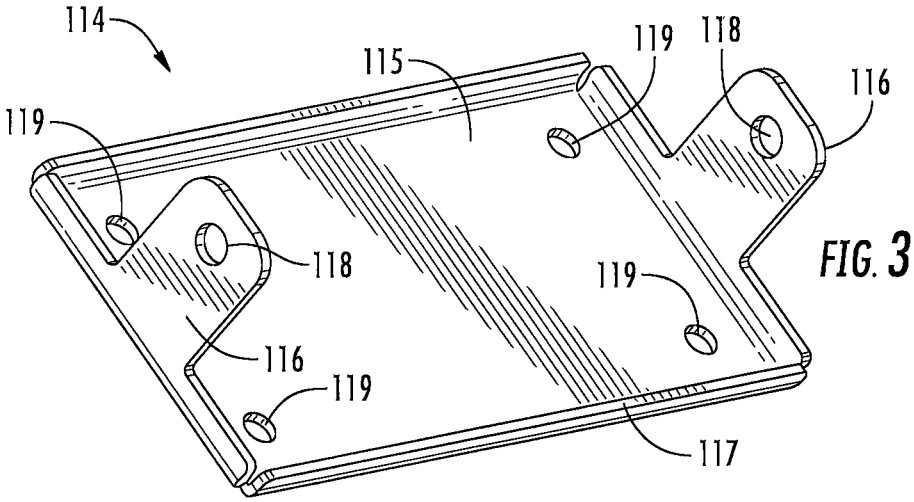
FIG. 3C is a perspective view of the mounting plate of FIG. 3B.
Figure 3D:
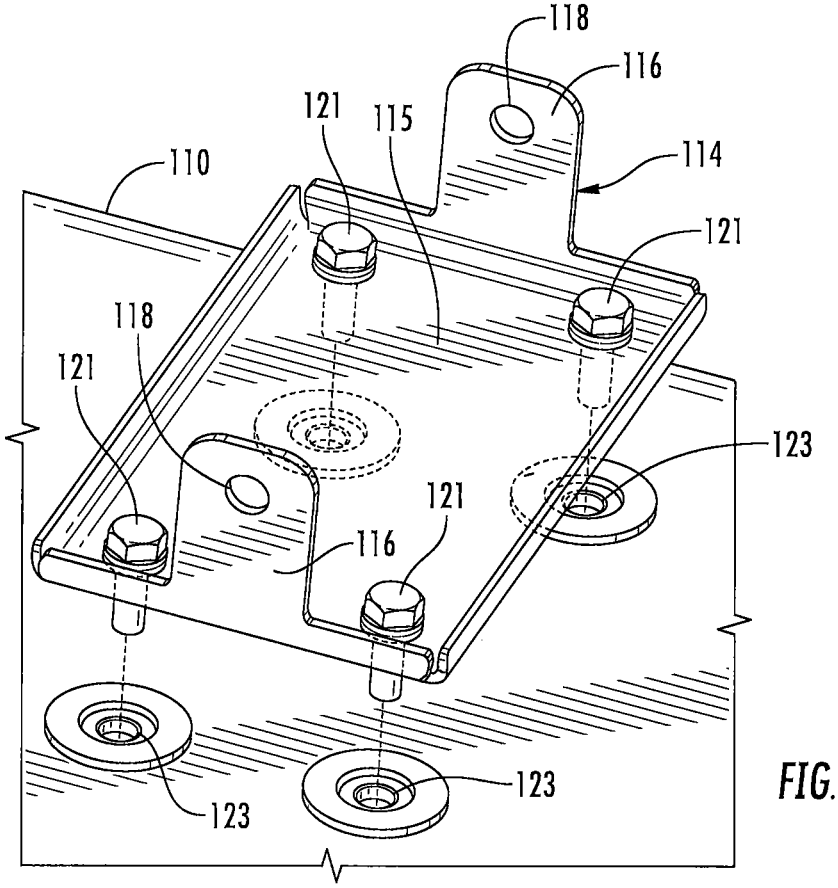
FIG. 3D is an enlarged exploded perspective view illustrating how the mounting plate of FIG. 3C is attached to the radome of FIGS. 1A-1F.

FIG. 3A is a perspective view of the radome 110. FIG. 3B is an enlarged perspective view of a portion of the back of the radome 110 that illustrates a mounting plate 114 thereof. FIG. 3C is a perspective view of the mounting plate 114. FIG. 3D is an enlarged exploded perspective view illustrating how the mounting plate 114 of FIG. 3C is attached to the radome 110.

Figure 3E:
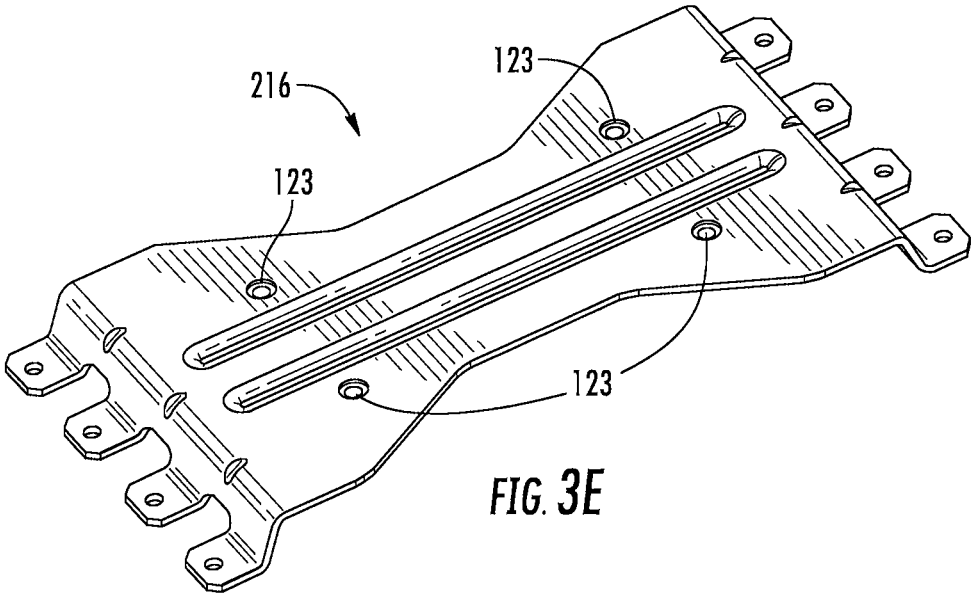
FIG. 3E is a perspective view of a bracket that may be used to mount the mounting plate to the antenna.

As noted above, a pair of mounting plates 114*a* and 114*b* may be mounted on the back side of the radome 110. As shown in FIGS. 3B-3D, each mounting plate 114 may comprise a base plate 115 that has two flanges 116 extending therefrom. A lip 117 may extend around the periphery of the base plate 115. Four mounting holes 119 are provided in the base plate 115. An aperture 118 is also provided near the distal end of each flange 116. Referring to FIG. 3E, a pair of spaced-apart brackets 216 may be provided that extend between the sidewalls 212 of ground plane structure 210. The brackets 216 provide mechanical rigidity to the ground plane structure 210 and also provide locations for mounting the above-described mounting brackets 114 through the radome 110. As shown in FIG. 3D, the mounting plates 114 may be secured to the antenna using bolts 121 that are threaded into holes 123 formed in brackets 216, radome 110 and/or ground plane 210. While a specific mounting structure is described for attaching the mounting plates 114 to the antenna, any suitable structure may be used.

Figure 4:
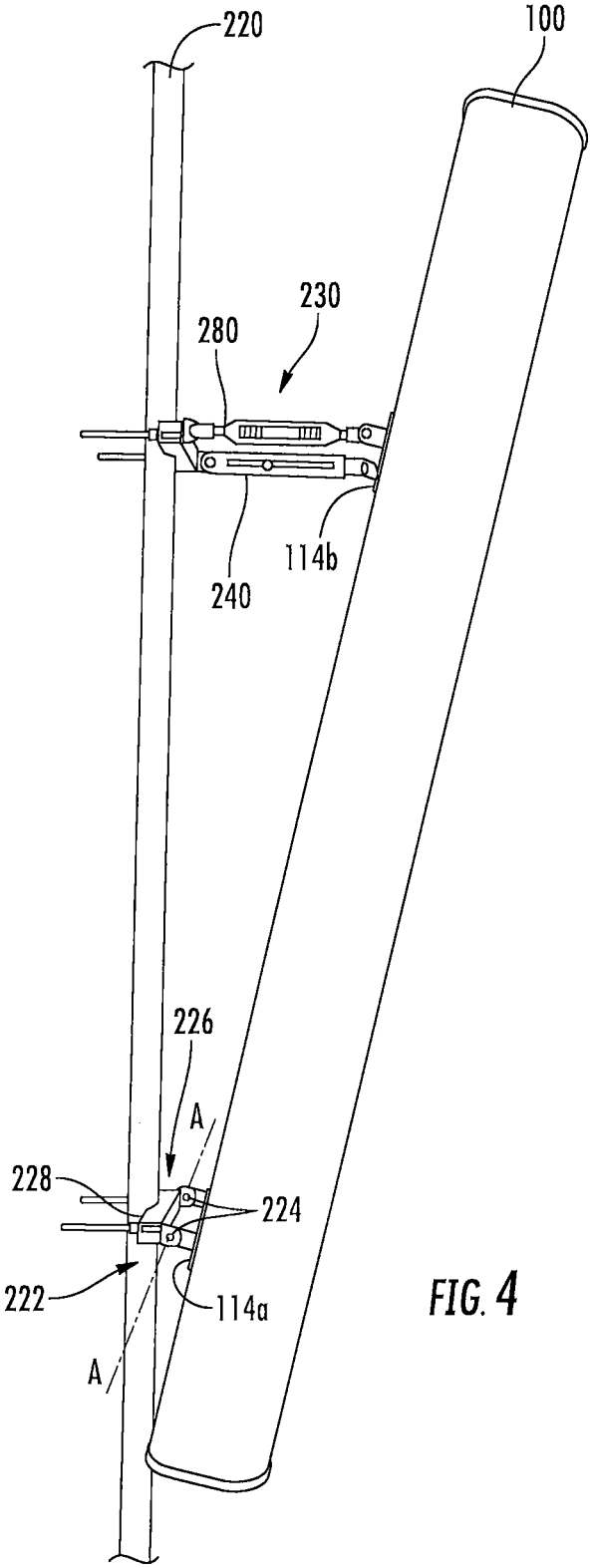
FIG. 4 is a side perspective view showing an embodiment of a mechanical tilt mounting system of the invention.
Figure 12:
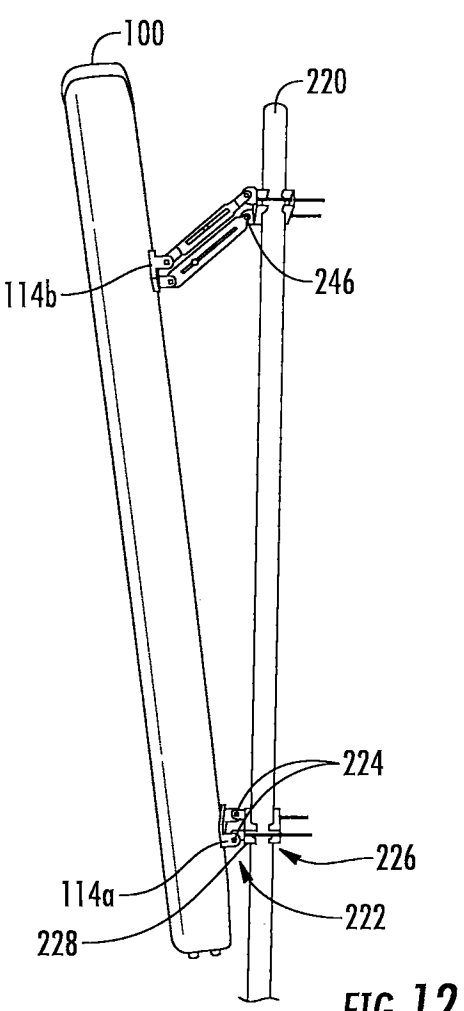
FIGS. 11 and 12 are side perspective views showing another embodiment of an adjustable antenna mounting system.
Figure 11:
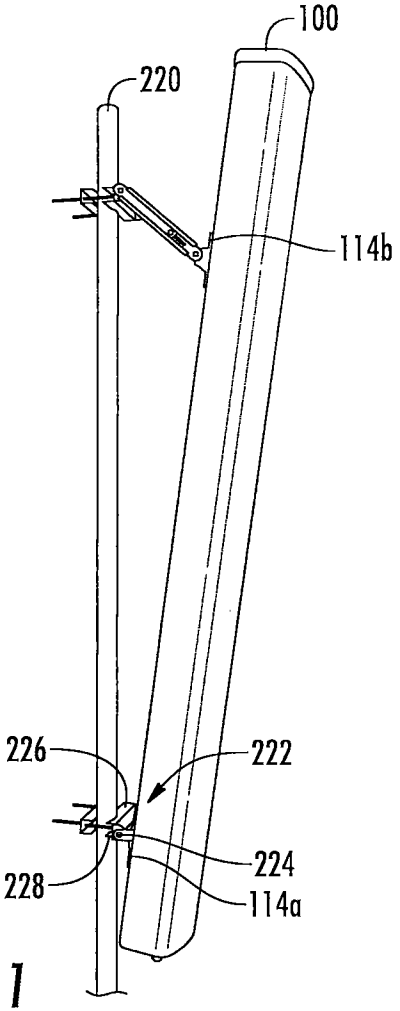
Figure 13:
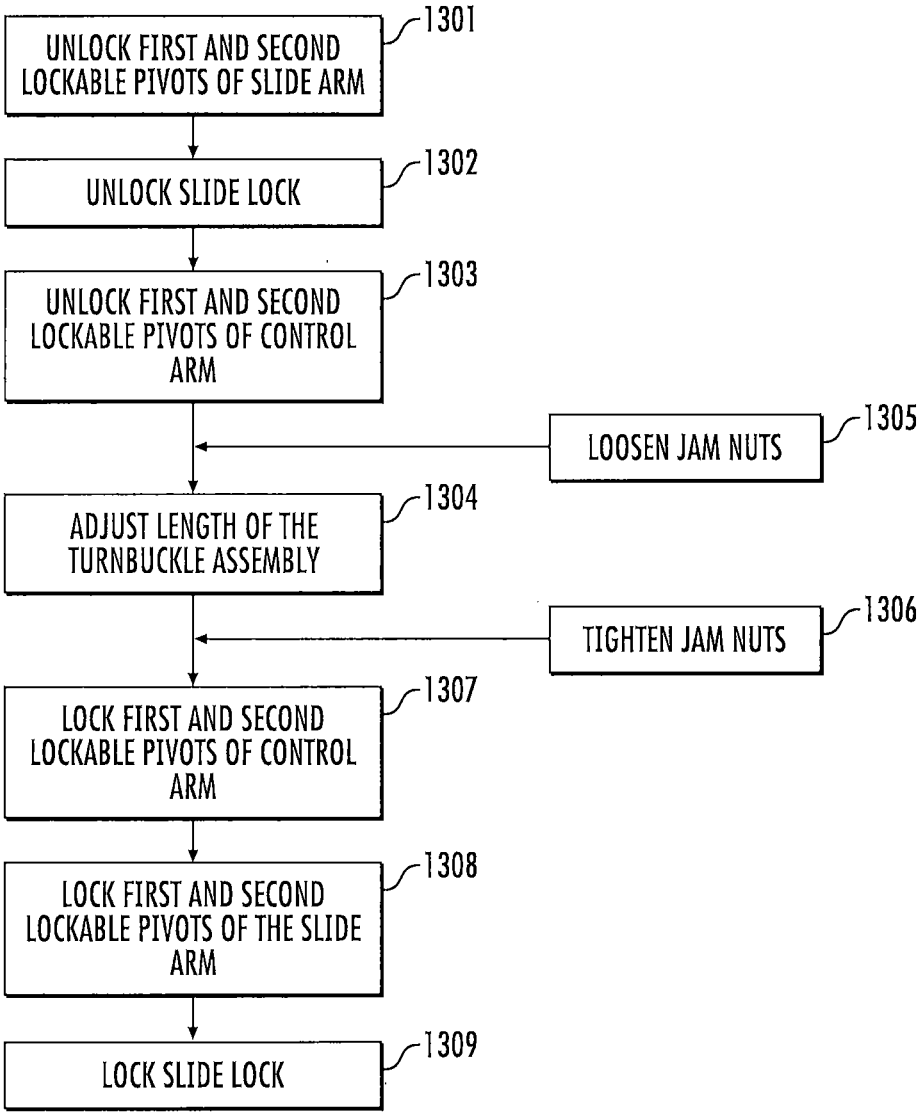
FIG. 13 is a block diagram illustrating a method of operating a mechanical tilt mounting system of the invention.
Figure 14:
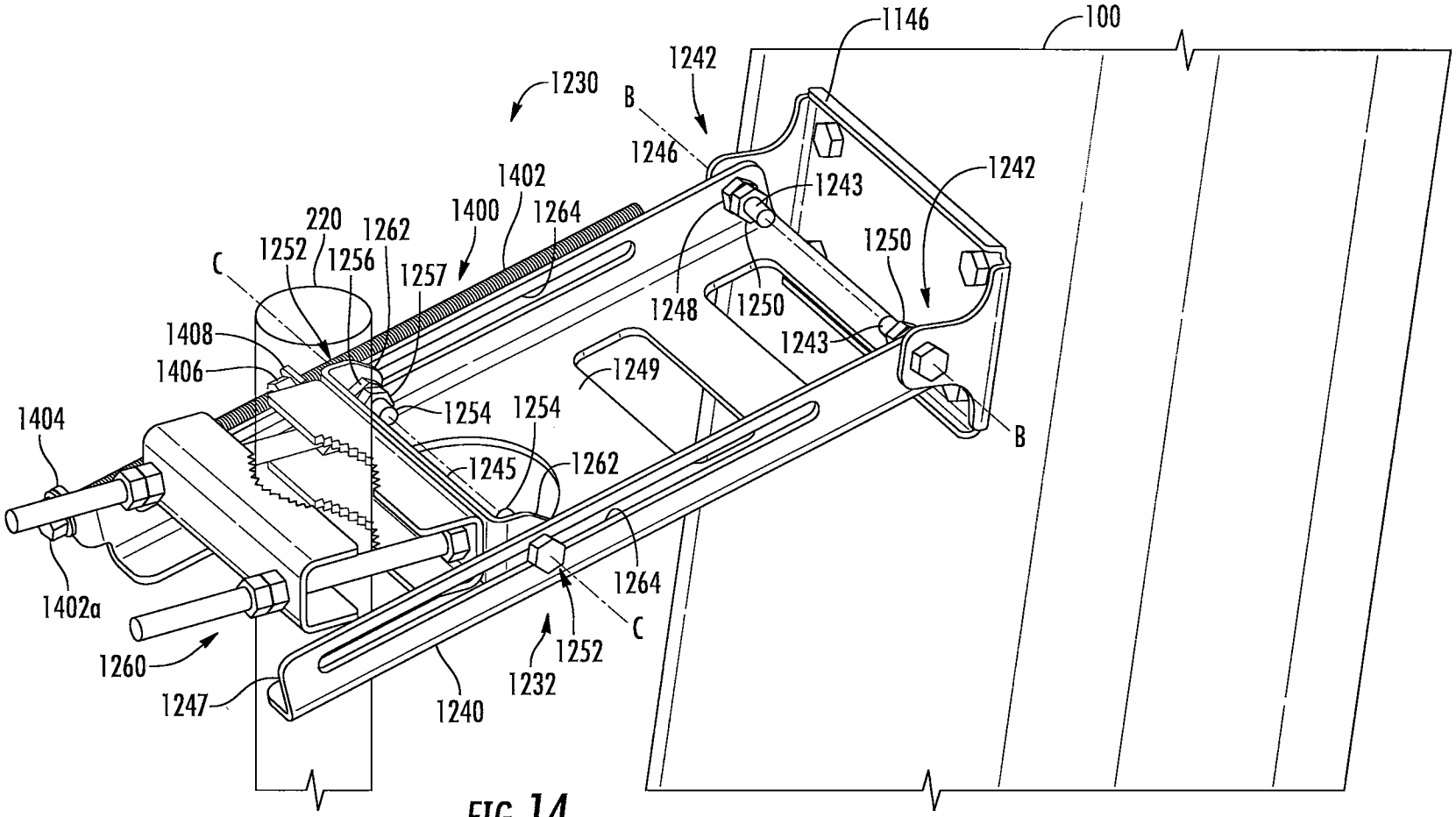
FIG. 14 is a perspective view showing another embodiment of an adjustable antenna mount usable in the mechanical tilt mounting system of the invention.
Figure 15:
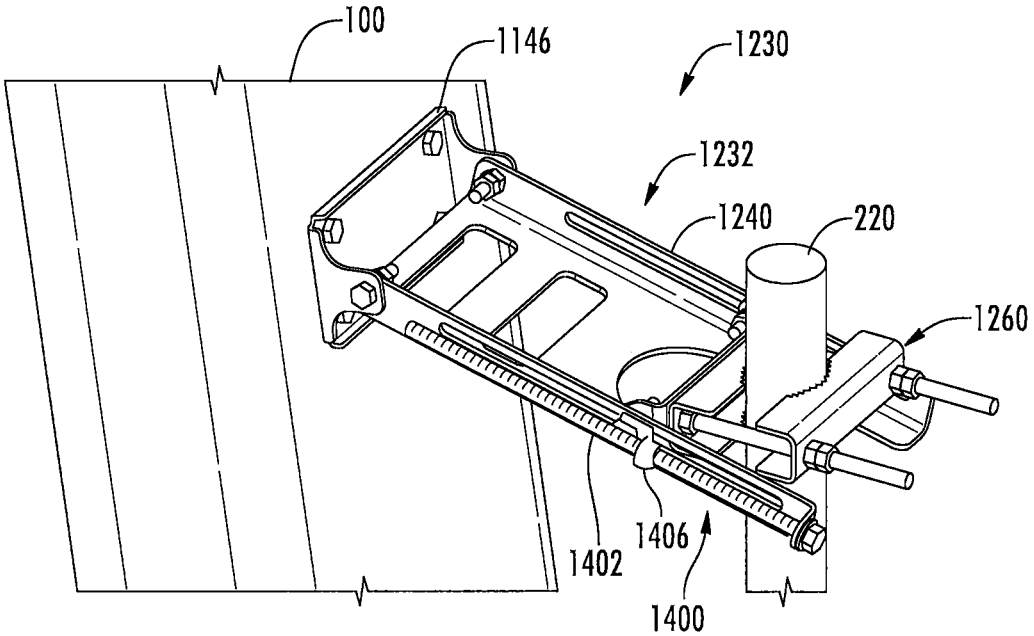
FIG. 15 is a second perspective view showing the embodiment of the adjustable antenna mount of FIG. 14.
Figure 16:
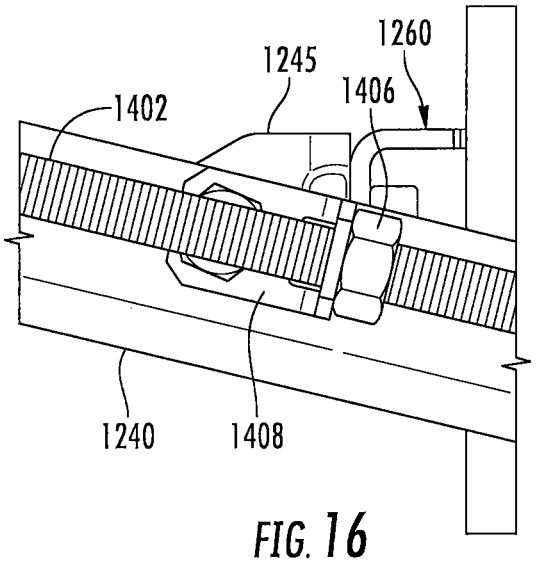
FIG. 16 is a detailed side view showing the embodiment of the adjustable antenna mount of FIG. 14.
Figure 17:
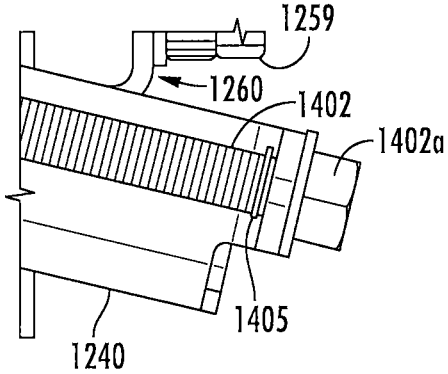
FIG. 17 is a second detailed side view showing the embodiment of the adjustable antenna mount of FIG. 14.

Embodiments of the adjustable tilt mounting system are shown in FIGS. 4, 11 and 12. The embodiments shown in FIGS. 4, 11 and 12 are in the most common "downtilt" orientation, wherein the top end of the antenna 100 is tilted downwardly away from vertical such that the antenna is rotated to a downward-facing inclination. For such a downtilt application, the bottom antenna mount provides a fixed axis of rotation and the top antenna mount is adjustable. For an "uptilt" application the brackets are reversed such that the bottom antenna mount is adjustable and the top antenna mount provides the fixed axis of rotation. In some embodiments, both the top antenna mount and the bottom antenna mount may be adjustable.

In the downtilt orientation, the lower mounting plate 114*a* is mounted to the antenna support structure 220 at a fixed pivot 222 where the axis of rotation A-A of the fixed pivot 222 is in a fixed positon relative to support structure 220. The fixed pivot 222 may comprise a mounting device 226 that is mounted on the antenna support structure 220 and that is connected to the lower mounting plate 114*a*. The mounting device 226 may comprise a pipe clamp 228, U-bolt or other similar structure that connects to the support structure 220 and that supports a bracket that has a pair of apertured flanges. The mounting device 226 is similar to the mounting device 260 as described hereinafter with respect to FIG. 5. A pair of pivot pins 224, such as threaded bolts, extend through the apertures 118 formed in the flanges 116 of lower mounting plate 114*a* and extend through the apertures formed on the flanges supported by mounting device 226 such that the lower bracket 114*a* and antenna 100 may pivot on the pivot pins 224. The threaded pivot pins 224 may be secured by mating threaded nuts that threadably engage the threaded pivot pins 224.

In other embodiments, a single pivot pin may extend through both of the flanges 116 of lower bracket 114*a* and both of the apertured flanges on the mounting device 226. Moreover, the pivot pins 224 may be unthreaded members that are secured by a cotter pin, clevis pin, cap, staking or the like. In the illustrated embodiment, the support structure 220 comprises a pole that may be mounted on a cell tower and the mounting device 226 comprises a pipe clamp 228 that is secured to the pole using bolts. The support structure 220 may be a structure other than the illustrated pole and the mounting device 226 may comprise any suitable mounting mechanism or structure. In one embodiment, the flanges 116 are free to rotate on pivot pins 224. In other embodiments, the flanges 116 may be fixed to the pivot pins 224 and the pivot pins 224 may rotate relative to the mounting device 226. In other embodiments, the pivot pins 224 may rotate relative to the bracket 228 and may also rotate relative to the flanges 116. Numerous other changes may be made in the fixed pivot 222 provided that the antenna 100 is free to pivot about the fixed pivot 222.

The upper bracket 114*b* is mounted to the support structure 220 using an adjustable mount 230 that functions to rotate the antenna 100 about the fixed pivot 222 to change the angular inclination or tilt of the antenna. Referring to FIGS. 5-8, in the illustrated embodiment, the adjustable mount 230 comprises two adjustable arms. The first arm is slide arm 240 and the second arm is control arm 280. The arms 240 and 280 are mounted to the antenna 100 at a first common axis of rotation B-B and are mounted to the antenna support structure 220 at a second common axis of rotation C-C.

The slide arm 240 is mounted to the upper mounting plate 114*b* by a lockable pivot 242. In one embodiment, the lockable pivot 242 comprises a pivot pin 243 that, as illustrated, comprises a threaded member such as a bolt that extends through aperture 118 on one of flanges 116 of upper bracket 114*b* and extends through an aperture 244 formed at one end of slide arm 240. The pivot pin 243 is secured by a mating threaded member 246, such as a nut, where the nut may be tightened to fix the position of the first slide arm 240 relative to the upper bracket 114*b* and loosened to allow relative pivoting motion therebetween about the pivot pin 243. In other embodiments, one of the pivot pin 243 or the threaded member 246 may be fixed to, or formed integrally with, the slide arm 240 or the flange 116 and the other one of the pivot pin 243 or the threaded member 246 may be rotatable relative thereto to releasably fix the position of the slide arm 240 relative to the upper bracket 114*a*. Any similar lockable pivot may be used that allows the slide arm 240 to be fixed in position relative to the upper bracket 114*a* and allows selective relative pivoting motion therebetween about axis B-B.

A lockable pivot 248 mounts the second end of slide arm 240 to the mounting device 260. The mounting device 260 may be similar to the mounting device 226 for the fixed pivot 222. In the illustrated embodiment, the support structure 220 comprises a pole that may be mounted on a cell tower, as previously described, and the mounting device 260 may comprise a bracket 245 that is secured to the pole using a bolt tightened pipe clamp 247. The bracket 245 includes spaced flanges 262 that define apertures (not visible in FIG. 5 but similar to apertures 118 on flanges 116) for connecting the arms 240 and 280 to the support structure 220. The support structure 220 may be a structure other than the illustrated pole and the mounting device 260 may comprise any suitable connection mechanism or device.

The lockable pivot 248 may be similar to the lockable pivot 242. The lockable pivot 248 comprises a pivot pin 243 such as a bolt or other threaded member that extends through an aperture on one of flanges 262 of mounting device 260 and extends through an aperture 264 formed at the second end of slide arm 240. The pivot pin 243 is secured by a mating threaded member such as a nut 246 (FIG. 12) such that the nut may be tightened to fix the position of the slide arm 240 relative to the mounting device 260 and loosened to allow relative pivoting motion therebetween about the pivot pin 243. In other embodiments, one of the pivot pin 243 or the mating threaded member may be fixed to, or formed integrally with, the slide arm 240 or the flange 262 and the other one of the pivot pin 243 or the threaded member may be rotatable relative thereto to releasably fix the position of the arm 240 relative to the mounting device 260. Any similar lockable pivot may be used that allows the arm 240 to be fixed in position relative to the mounting device 260 and allows selective relative pivoting motion therebetween about axis C-C.

The slide arm 240 is expandable and contractable such that the length of the slide arm 240 is adjustable. The slide arm 240 includes a first arm section 250 and a second arm section 252. The arm sections 250, 252 are slidably mounted relative to one another such that the position of the arm sections 250, 252 relative to one another may be adjusted to adjust and set the length of the slide arm 240. The arm sections 250 and 252 may be secured to one another to fix the length of the arm 240.

In one embodiment, the arm section 250 comprises an elongated member 254 and a pair of opposed L-shaped flanges 256, 258 that extend along opposite edges of the elongated member 254. The flanges 256, 258 extend for a substantial portion of the length of the first arm section 250 such that the elongated member 254 and the flanges 256, 258 together create a C-shaped channel 263 that slidably receives the second arm section 252. The elongated member 254 also defines a slot 266 that extends along the length of the first arm section 250, parallel to the opposed flanges 256, 258.

The second arm section 252 comprises an elongated member that is slidably received in the C-shaped channel 263. The second arm section 252 is dimensioned such that the opposite edges 252*a*, 252*b* of the second arm section 252 are slidably received in flanges 256, 258, respectively, such that the second arm section 252 can reciprocate relative to the first arm section 250 but is otherwise constrained relative thereto.

Figure 9:
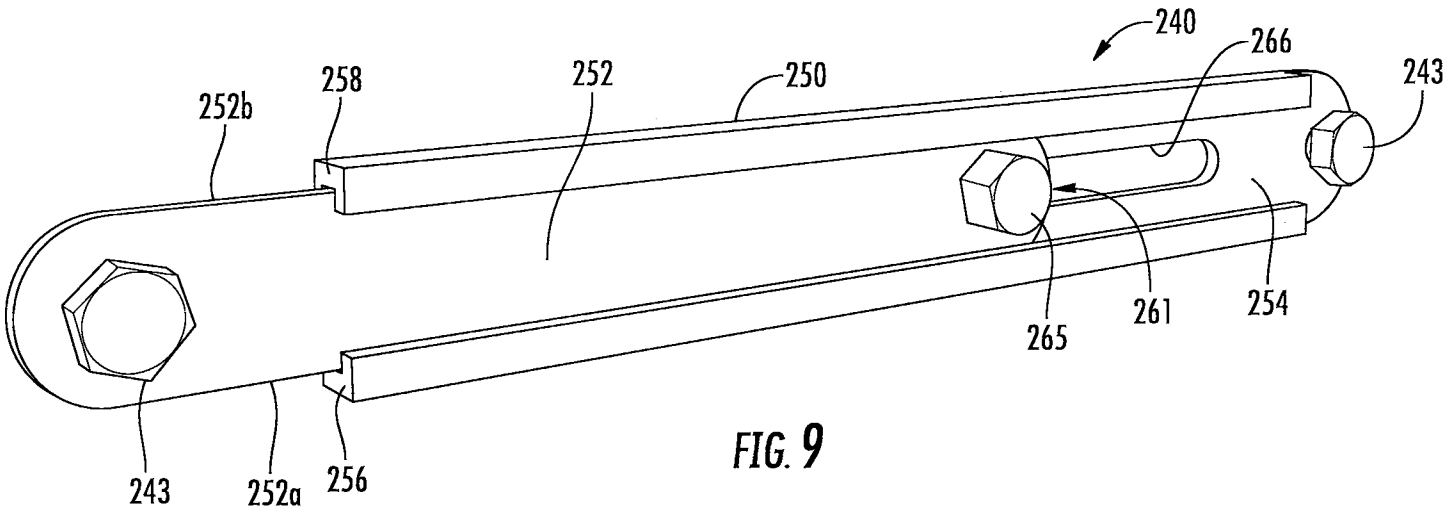
FIG. 9 is a perspective view of the slide arm of FIG. 6.
Figure 10:
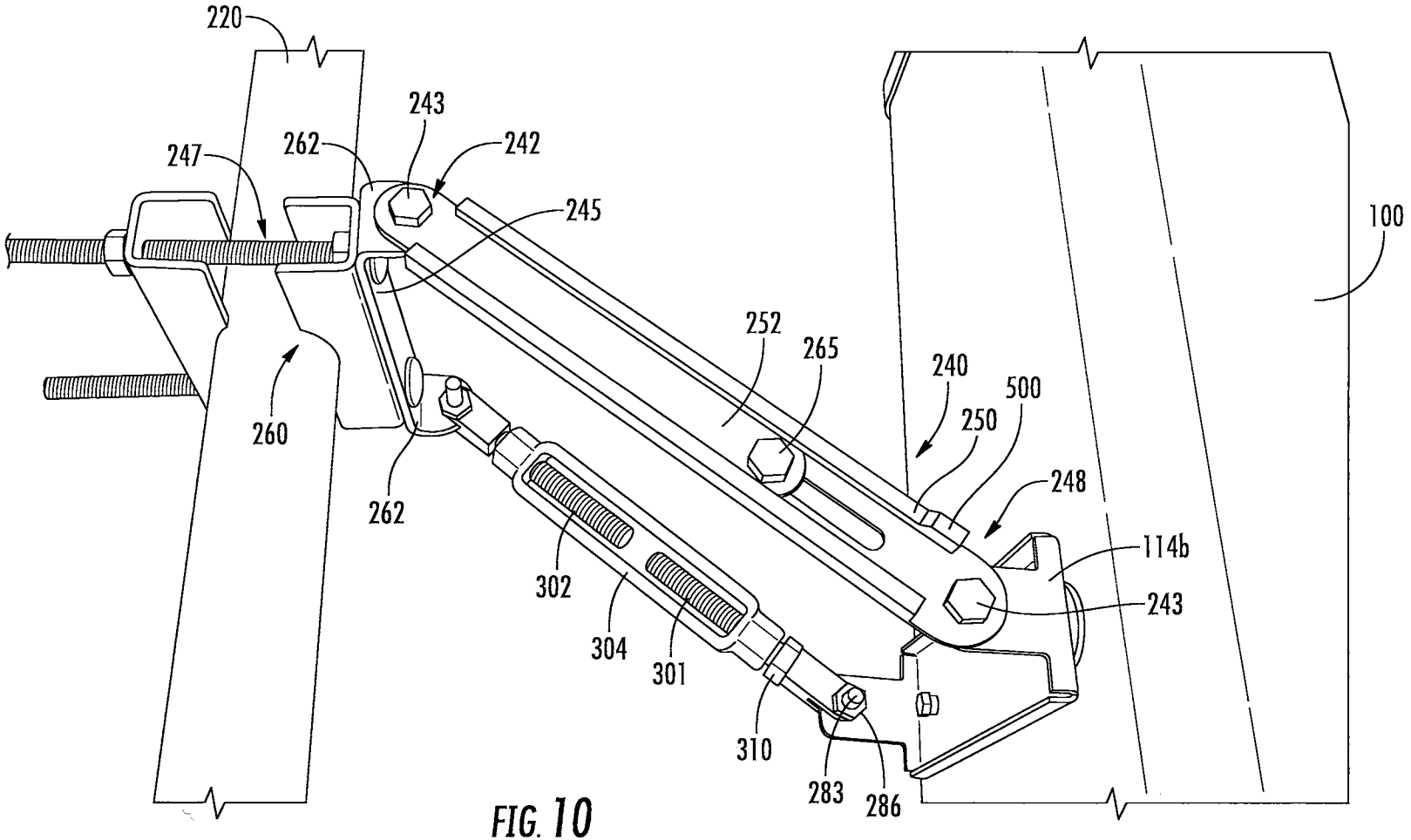
FIG. 10 is a perspective view showing an embodiment of an adjustable antenna mount mounted to an antenna and antenna support structure.

A releasable slide lock 261 (FIG. 9) is provided for fixing the position of the first arm section 250 relative to the second arm section 252. The slide lock 261 comprises an aperture 267 on the second arm section 252 that receives a fastener 265 such as a bolt or other threaded member that extends through the aperture 267 into the slot 266 in the first arm section 250. The fastener 265 is secured by a mating threaded member 268 (FIG. 7), such as a threaded nut, such that the threaded member 268 may be tightened on fastener 265 to fix the position of the first arm section 250 relative to the second arm section 252 and loosened to allow relative linear motion therebetween.

When all of the lockable pivot 242, the lockable pivot 248 and the slide lock 261 are loosened or unlocked, the slide arm 240 may be pivoted relative to the bracket 114*b* and the mounting device 260 and the length of the slide arm 240 may be adjusted accordingly. In the unlocked or loosened condition of slide arm 240, the position of the antenna 100 is adjustable and the antenna 100 may be pivoted relative to the antenna support 220 to adjust the angle of inclination of the antenna. When all of the lockable pivot 242, lockable pivot 248 and the slide lock 261 are tightened or locked, the slide arm 240 may not pivot relative to the bracket 114*b* and the mounting device 260 and the length of the slide arm 240 is fixed. In this condition, the angular position of the antenna 100 is fixed relative to the antenna support 220.

Control arm 280 is mounted to the upper bracket 114*b* by a lockable pivot 282. The lockable pivot 282 may be similar to the lockable pivots 242, 248 as previously described. In one embodiment, the lockable pivot 282 comprises a fastener 283 such as a bolt or other threaded member that extends through aperture 118 on the other one of flanges 116 of upper bracket 114*a* and extends through apertures 284 formed at one end of control arm 280. The fastener 283 is secured by a mating threaded member 286, such as a threaded nut, such that the nut may be tightened to fix the position of the control arm 280 relative to the upper bracket 114*a* and loosened to allow relative pivoting motion therebetween about the fastener 283. In the illustrated embodiment the end of control arm 280 is formed as two spaced flanges 290 that receive flange 118 therebetween such that when the fastener 283 is secured by the mating threaded member 286 the flanges 290 are deformed into engagement with the flange 118 to fix the position of the arm 280 relative to the upper bracket 114*a*. In other embodiments, one of the fastener 283 or the threaded member 286 may be fixed to, or formed integrally with, the arm 280 or to the flange 118 and the other one of the fastener 283 or the threaded member 286 may be rotatable relative thereto to releasably fix the position of the arm 280 relative to the upper bracket 114*a*. Any lockable pivot may be used that allows the arm 280 to be fixed in position relative to the upper bracket 114*a* and allows selective relative pivoting motion therebetween.

A lockable pivot 291 also mounts the second end of control arm 280 to the mounting device 260 that is secured to support structure 220. The lockable pivot 291 may be the same as the lockable pivot 282 and may include a fastener 283 such as a bolt or other threaded member that extends through aperture 118 on the other one of flanges 262 of mounting device 260 and extends through apertures 284 formed at the opposite end of arm 280. The fastener 283 is secured by a mating threaded member 286 such as a nut such that the nut may be tightened to fix the position of the arm 280 relative to the mounting device 260 and loosened to allow relative pivoting motion therebetween about the fastener 283. In the illustrated embodiment, the second end of control arm 280 is also formed as two spaced flanges 290 that receive flange 262 therebetween such that when the fastener 283 is secured by the mating threaded member 286 the flanges 290 are deformed into engagement with the flange 262 to fix the position of the control arm 280 relative to the mounting device 260. In other embodiments, one of the fastener 283 or the threaded member 286 may be fixed to, or formed integrally with, the arm 280 or to the flange 262 and the other one of the fastener 283 or the threaded member 286 may be rotatable relative thereto to releasably fix the position of the control arm 280 relative to the mounting device 260. Any similar lockable pivot may be used that allows the arm 280 to be fixed in position relative to the upper antenna support bracket 260 and allows selective relative pivoting motion therebetween.

The lockable pivots 242 and 282 together define the first common axis of rotation B-B. The lockable pivots 248 and 291 together define the second common axis of rotation B-B.

The second control arm 280 comprises a turnbuckle assembly comprising a first threaded member 301 and a second threaded member 302 threadably engaged with frame 304. One of the first threaded member 301 and the second threaded member 302 is a left-hand thread and the other of the first threaded member 300 and the second threaded member 302 is a right-hand thread such that rotation of the frame 304 causes both threaded members 301 and 302 to be simultaneously screwed into or out of the frame 304 to thereby adjust the length of the control arm 280. One of the threaded members 301 terminates in the lockable pivot 282 at the distal end thereof and the other threaded member 302 terminates in the lockable pivot 291 at the distal end thereof such that the turnbuckle assembly extends between and connects the mounting device 260 and the antenna bracket 114*b*.

The locking pivots 282, 291 may be loosened or unlocked to allow the control arm 280 to pivot relative to the antenna 100 and the antenna support 220. The frame 304 of the turnbuckle assembly may then be rotated to extend or retract threaded members 301 and 302 to thereby lengthen or shorten control arm 280 to tilt the antenna 100.

Jam nuts 310 may be provided on the threaded members 301 and 302 and may be tightened into engagement with the frame 304 after the length of the control arm 280 is set to prevent inadvertent rotation of the threaded members 301, 302 during use of the antenna 100. The jam nuts 310 may be loosened to allow rotation of the threaded members 301, 302.

While the mechanism for extending and contracting the control arm is described as including a turnbuckle assembly, the mechanism may comprise other linear movement devices such as a rack and pinion where a rack is mounted on a first arm section and a pinion is mounted on a second arm section and engages the rack such that manual rotation of the pinion extends and/or retracts the first arm section relative to the second arm section. Another mechanism for extending and contracting the control arm may comprise a ratcheting linear drive. Other suitable drives may also be used.

An embodiment of a method of operating the mechanical tilt mounting system will now be described. To adjust the angle of inclination or tilt of the antenna 100, the first lockable pivot 242 and the second lockable pivot 248 are unlocked such that the slide arm 240 may rotate relative to the antenna bracket 114*b* and the mounting device 260 (Block 1301). Specifically, the fasteners 243 are loosened. The slide lock 261 is also unlocked to allow the first arm section 250 to slide relative to the second arm section 252 (Block 1302). Specifically, the fastener 265 is loosened. The lockable pivot 282 and the lockable pivot 291 are unlocked such that the control arm 280 may rotate relative to the antenna bracket 114*b* and the mounting device 260 (Block 1303). Specifically, the fasteners 283 are loosened. The frame 304 is then rotated to simultaneously extend or retract the threaded members 301, 302 to lengthen or shorten control arm 280 and pivot the antenna 100 about the fixed pivot 222 to increase or decrease the angle of inclination of the antenna (Block 1304). If jam nuts 310 are provided on the turnbuckle assembly, the jam nuts 310 are loosened before the frame 304 is rotated (Block 1305). Once the desired angle of inclination is achieved, the jam nuts 310 may be retightened into engagement with the frame 304 to lock the position of the threaded members 301, 302 relative to the frame 304 (Block 1306). The lockable pivot 282 and the lockable pivot 291 are locked such that the control arm 280 is prevented from rotating relative to the antenna bracket 114*b* and the antenna support bracket 260 (Block 1307). Specifically, the fasteners 283 are tightened. After the angle of inclination is set, the slide arm 240 is locked in position. The lockable pivot 242 and the lockable pivot 248 are locked such that the slide arm 240 is prevented from rotating relative to the antenna bracket 114*b* and the mounting device 260 (Block 1308). Specifically, the fasteners 243 are tightened. The slide lock 261 is also locked to lock the first arm section 250 to the second arm section 252 (Block 1309). Specifically, the fastener 265 is tightened. The antenna 100 is thereby held at the desired angle of inclination.

The adjustable mount 230 does not create loose components during the adjustment process. While the lockable pivots 242, 248, 282 and 291 and the slide lock 261 are loosened, the threaded bolts and nuts do not need to be completely unthreaded such that there are no loose components to be dropped. In one embodiment, the threaded fasteners may be staked or deformed after the nut is threaded on the bolts to make is impossible to completely unthread the nut from the fastener.

The turnbuckle assembly also allows the tilting of the antenna 100 to be accomplished easily with one hand. After the lockable pivots 242, 248, 282 and 291 and the slide lock 261 are unlocked or loosened, the rotation of the frame 304 adjusts the angle of inclination of the antenna 100 where the frame 304 may be rotated with one hand. Rotating the frame 304 also allows for precise control of the angle of inclination of the antenna 100 as the rotation of the frame results in a corresponding precise lengthening or shortening of the control arm 280. The frame 304 can also be released during the adjustment process and the control arm 280 and antenna will remain in a static position.

In the embodiment illustrated in FIGS. 8 through 13 a control arm 280 and a slide arm 240 are provided to stably hold the antenna 100; however, in some embodiments the slide arm 240 may be eliminated and a single control arm 280 may be used to support the antenna and adjust the angle of inclination.

In other embodiments, the slide arm 240 may be eliminated and a second control arm 280 may be used in its place. One advantage of using the slide arm 240 with the control arm 280 is that the length of the slide arm 240 need not be precisely controlled during the adjustment of the length of the control arm 280 and the slide arm 240 may be allowed to freely slide as the control arm 280 is adjusted. If two control arms 280 are used, both control arms must be adjusted simultaneously and the frames 304 of each of the two control arms 280 must be rotated at approximately the same time, rate and in the same direction. While the adjustment of the two control arms must be performed substantially simultaneously, there is some tolerance in the system to allow some difference in the adjustment of the two control arms such that the arms need not be adjusted exactly the same.

In other embodiments, the control arm 280 may be eliminated and a second slide arm 240 may be used in its place.

The system of the invention may also eliminate pinch points by eliminating scissor action between components.

The geometry of the system may be changed to account for the desired range of inclination angles. In one embodiment the lower pivot A-A and the upper pivot axis B-B may be substantially vertically aligned in the vertical position of the antenna such that when the antenna has an angle of inclination of 0° (vertical) the arms 240, 280 extend horizontally. To adjust the angle of inclination from the vertical position, the arms 240, 280 are lengthened such that the distal ends of the arms rotate downwardly as they are extended. In such an embodiment, the lower fixed pivot 222 may be spaced from the antenna 100 the same distance as the length of the arms 240, 280 in their shortest configuration. In other words the length of the flanges 116 of the lower bracket 114*a* are the same length as the length of the arms 240, 280 in their shortest configuration In other embodiments, the arms may be at an angle relative to horizontal in when the antenna has an angle of inclination of 0° (vertical). In such embodiments the axis B-B may be vertically offset from axis C-C (FIGS. 11 and 12) when the antenna is vertical or near vertical. It is also to be understood that the antenna need not be able move to a completely vertical position if such a position is not required by system operations and that the range of the angle of inclination may vary based on system geometry.

Another embodiment of an adjustable antenna mount is shown in FIGS. 14-20D. The upper bracket 114*b* of antenna 100 is mounted to the support structure 220 using an adjustable mount 1230 that functions to rotate the antenna 100 about the fixed pivot 222 to change the angular inclination or tilt of the antenna 100. In the illustrated embodiment, the adjustable mount 1230 comprises an adjustable arm 1232 having an effective length that may be expanded and contracted to change the angle of inclination of the antenna 100. The adjustable arm 1232 is mounted to the antenna 100 at a first axis of rotation B-B and is mounted to the antenna support structure 220 at a second axis of rotation C-C. The adjustable arm 1232 comprises a first member 1240 that is movably mounted to a second member 1245. In the illustrated embodiment, the first member 1240 may comprise a frame made of a flat, rigid plate formed to have a generally U-shape in cross-section. The frame 1240 has a pair of parallel side flanges 1246 and 1247 connected by a base flange 1249. The first member 1240 may have different configurations and constructions other than as specifically shown and described herein. For example, the first member 1240 may be made of multiple parts secured together. The first member 1240 may have a box shape, an I-shape or other shape different than that shown in the figures.

The first member 1240 is mounted to the upper mounting plate 114*b* by lockable pivots 1242 that form the first axis of rotation B-B. In one embodiment, each lockable pivot 1242 comprises a pivot pin 1243 that, as illustrated, comprises a threaded member, such as a bolt, that extends through aperture 118 on one of flanges 116 of upper bracket 114*b* and extends through an aperture (not shown) formed at one end of side flanges 1246, 1247. The pivot pins 1243 are secured by mating threaded members 1248, such as a nut, where the nut may be tightened to fix the position of the first member 1240 relative to the upper bracket 114*b* and loosened to allow relative pivoting motion therebetween about the pivot pins 1243. In other embodiments, one of the pivot pins 1243 or the threaded members 1248 may be fixed to, or formed integrally with, the frame 1240 or the upper bracket 114*b* and the other one of the pivot pin 1243 or the threaded member 1248 may be rotatable relative thereto to releasably fix the position of the first member 1240 relative to the upper bracket 114*a*. Jam nuts 1250 may optionally be provided that may be tightened into engagement with the threaded members 1248 after the position of the antenna is set to prevent inadvertent movement of the antenna 100. Any similar lockable pivot may be used that can be locked to allow the first member 1240 to be fixed in position relative to the upper bracket 114*a* and unlocked to allow selective relative pivoting motion therebetween about axis B-B.

Lockable pivots 1252 mount the second end of first member 1240 to a second member 1245. The second member 1245 is mounted on support structure 220 by a mounting device 1260 such that the second member 1245 is fixed in position. In the illustrated embodiment, the support structure 220 comprises a pole that may be mounted on a cell tower, as previously described, and the mounting device 1260 may comprise a bolt tightened pipe clamp 247 that secures the second member 1245 of the adjustable antenna mount 1230 to the pole 220. The support structure 220 may be a structure other than the illustrated pole and the mounting device 1260 may comprise any suitable connection mechanism or device that secures the antenna 100 to the support structure.

The lockable pivots 1252 may be similar to the lockable pivots 1242. The second member 1245 may comprise a bracket that includes spaced side flanges 1262 and a base flange 1263 that connects the side flanges 1262. In one embodiment, the base flange 1263 may be fixed to the mounting device 1260 by bolts 1259. The side flanges 1262 of the bracket 1245 extend generally parallel to the side flanges 1246, 1247 of frame 1240. The spaced flanges 1262 define apertures (not shown). The lockable pivots 1252 each comprise a pivot pin 1254, such as a bolt or other threaded member, that extend through slots 1264 formed in the side flanges 1246, 1247 of frame 1240 and through the apertures on each of flanges 1262 of bracket 1245. The pivot pins 1254 are secured by a mating threaded member such as nuts 1256 such that the nuts may be tightened to fix the position of the frame 1240 relative to the bracket 1245 and mounting device 1260 and loosened to allow relative motion between about the pivot pins 1254 and the frame 1240. Jam nuts 1257 may optionally be provided that may be tightened into engagement with the threaded members 1256 after the position of the antenna is set to prevent inadvertent movement of the antenna 100. In other embodiments, one of the pivot pin 1254 or the mating threaded member 1256 may be fixed to, or formed integrally with, the bracket 1245 and the other one of the pivot pin 1254 or the threaded member 1256 may be rotatable relative thereto to releasably fix the position of the frame 1240 relative to the mounting device 1260. Any similar lockable pivot may be used that allows the frame 1240 to be fixed in position relative to the bracket 1245 and allows selective relative motion therebetween.

A linear drive 1400 is provided to move the frame 1240 relative to the bracket 1245 to thereby increase and decrease the effective length of arm 1232 and rotate the antenna 100. In one embodiment, the linear drive 1400 comprises a lead screw 1402 that is mounted for rotational movement along its longitudinal axis. The lead screw 1402 extends parallel to and adjacent one of the slots 1264. In the illustrated embodiment, the lead screw 1402 is rotatably supported in a bearing 1404 that is fixed to the frame 1240 and threadably engages a threaded follower 1406 that is secured to the bracket 1245 by one of pivot pins 1254. In the illustrated embodiment, the bearing 1404 is formed as part of the frame 1240 although a separate bearing structure may be secured to the frame 1240. A lock washer 1405 may be used to secure the lead screw 1402 to the frame 1240. The follower 1406 is a threaded member, such as a nut, that is secured to the frame 1240 by a bracket 1408.

When the lead screw 1402 is rotated, the follower 1406 traverses the length of the lead screw 1402. Because the follower 1406 is in a fixed position by virtue of its connection to the bracket 1245 (the bracket 1245 being fixed to the support structure 220 by the mounting device 1260), the rotation of the lead screw 1402 causes the frame 1240 to extend away from the bracket 1245 and support structure 220 when the lead screw 1402 is rotated in a first direction and to retract toward the bracket 1245 and support structure 220 when the lead screw 1402 is rotated in a second direction, opposite to the first direction. As the frame 1240 extends the effective length of the arm 1230 is increased and as the frame 1240 retracts the effective length of the arm 1230 is decreased. The effective length of the arm is increased when the distance between the rotational axes B-B and C-C increases and the effective length of the arm is decreased when the distance between the rotational axes B-B and C-C decreases eventhough the actual length of the arm 1230 (between the ends of frame 1245) does not necessarily change. Extension and retraction of the frame 1240 rotates the antenna 100 about the fixed bottom pivot 222 to change its angle of inclination relative to vertical. The head 1402*a* of the lead screw 1402 may be formed with a connector, such as a hex connector, such that it may be engaged by a rotary drive tool, such as a conventional cordless drill. Use of the power driver to rotate the lead screw 1402 makes adjustment of the antenna quick and easy. While a specific linear drive 1400 is described, the linear drive may comprise other suitable drive mechanisms such as a ball screw, roller screw, rack and pinion, belt drive, ratcheting linear drive or the like.

Figure 18D:
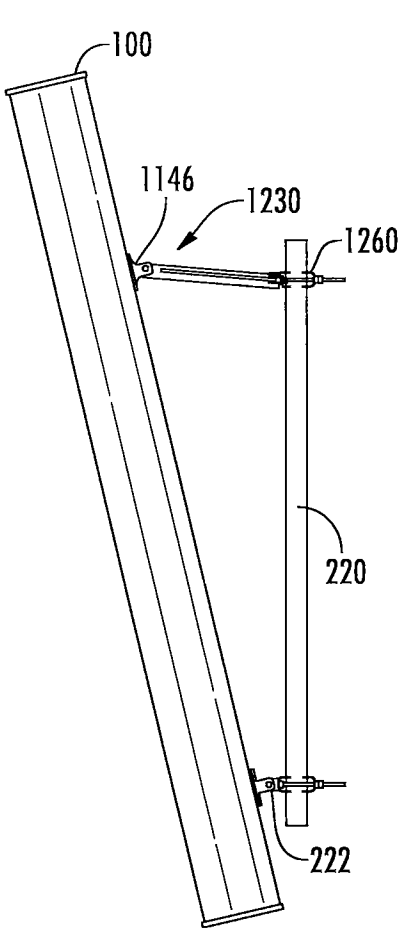
FIGS. 18A-18D are side views illustrating the operation of the embodiment of the adjustable antenna mount of FIG. 14.
Figure 18C:
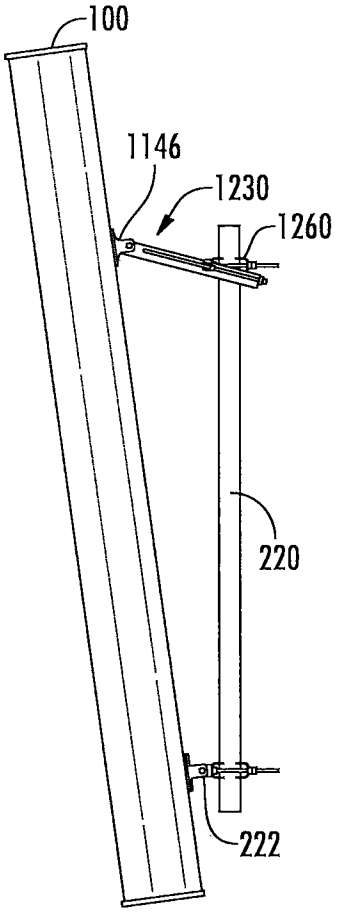
Figure 18B:
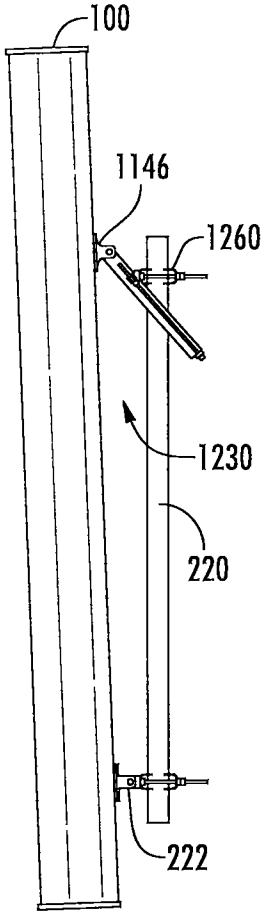
Figure 18A:
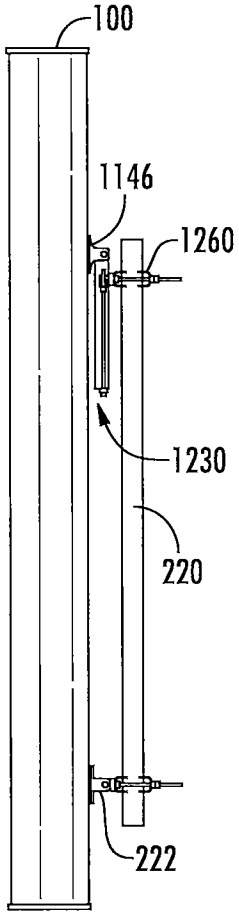
Figure 19B:
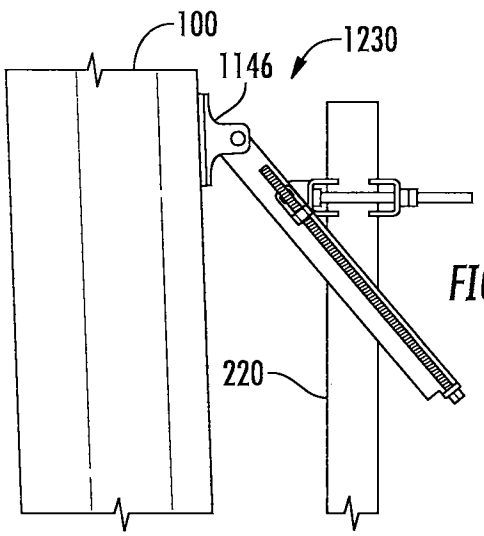
FIGS. 19A-19D are detailed side views illustrating the operation of the embodiment of the adjustable antenna mount of FIG. 14.
Figure 19D:
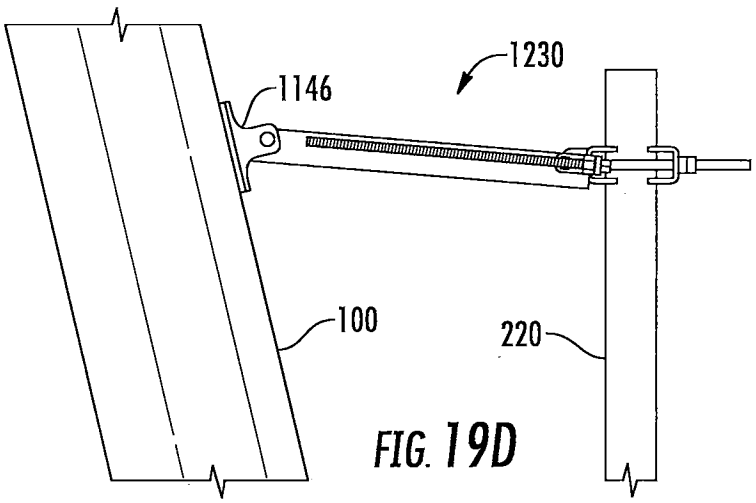
Figure 19A:
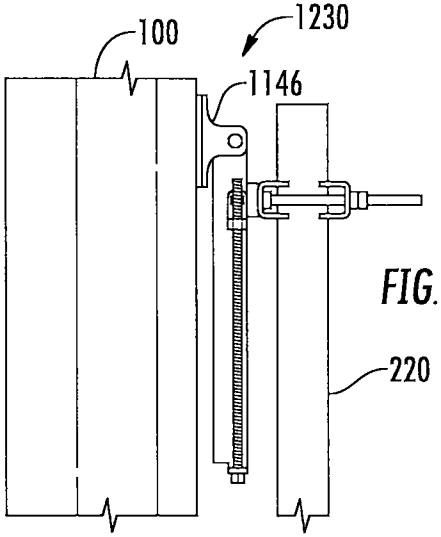
Figure 19C:
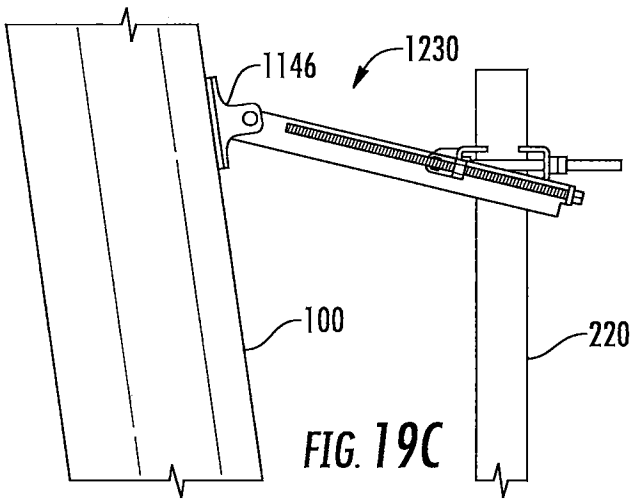
Figure 20B:
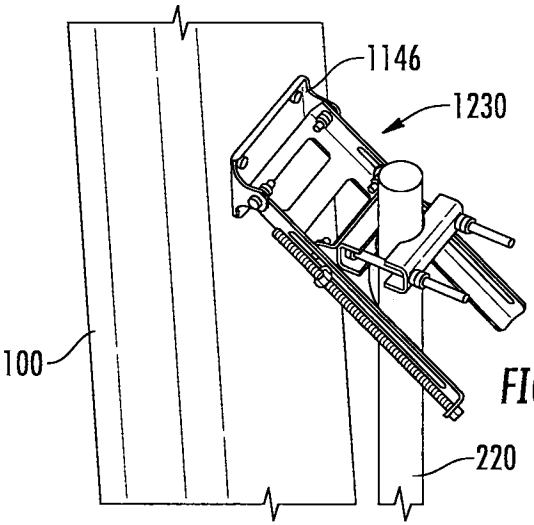
FIGS. 20A-20D are perspective views illustrating the operation of the embodiment of the adjustable antenna mount of FIG. 14.
Figure 20D:
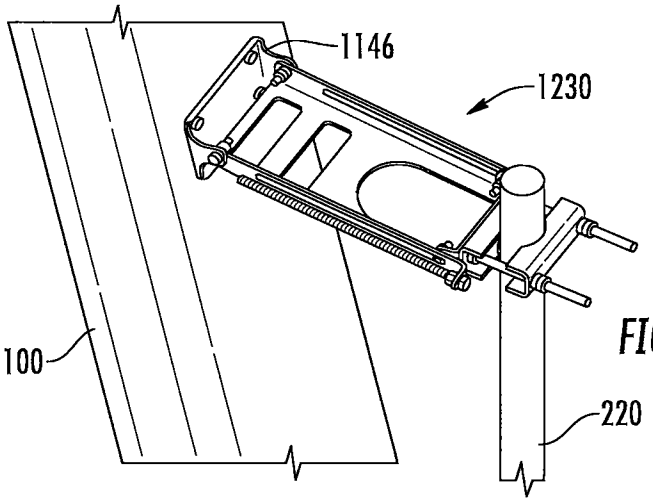
Figure 20A:
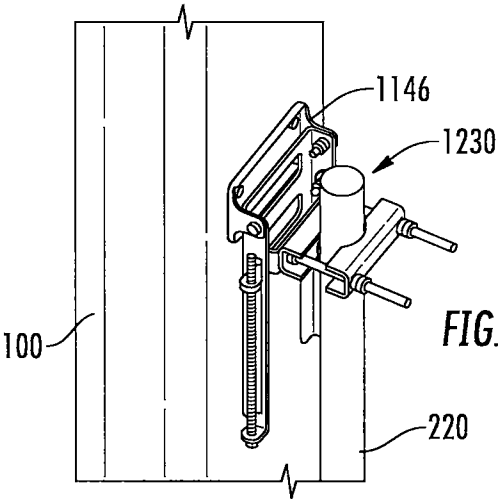
Figure 20C:
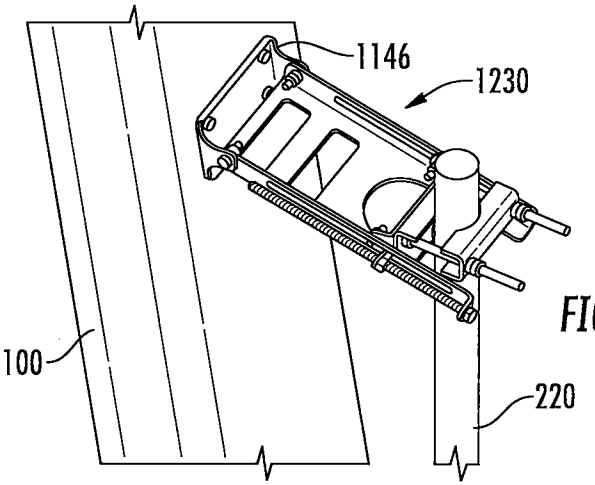
Figure 21:
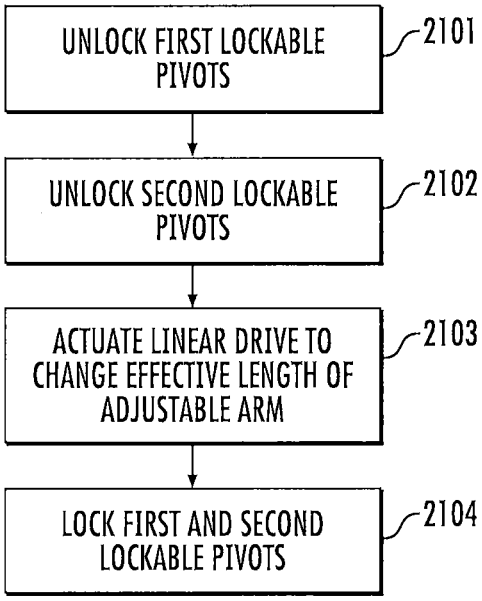
FIG. 21 is a block diagram illustrating a method of operating a mechanical tilt mounting system of the invention.

An embodiment of a method of operating the mechanical tilt mounting system will now be described. For purposes of explanation it is assumed that the antenna is initially in the vertical position as shown in FIGS. 18A, 19A and 20A. In actual use of the adjustable mount the antenna 100 may assume any inclination angle to begin the adjustment process. To adjust the angle of inclination or tilt of the antenna 100, the first lockable pivots 1242 are unlocked such that the frame 1240 may rotate relative to the upper bracket 114*b* (Block 2101). The second lockable pivots 1248 are unlocked such that the frame 1240 may rotate and translate relative to the bracket 1245 (Block 2102). Specifically, the fasteners 1243 are loosened to unlock the lockable pivots 1242, 1248. If jam nuts are provided on the fasteners 1243, the jam nuts are loosened before the fasteners are unlocked. After both lockable pivots 1242, 1248 are unlocked, the linear drive is actuated (Block 2103). Specifically, the lead screw 1402 is rotated. The lead screw 1402 may be engaged and rotated by a power driver. Because the follower 1406 is fixed in position relative to the support 220 by bracket 1245 and the mounting device 1260, rotation of the lead screw 1402 causes the lead screw 1402 to travel along the length of its axis. Because the lead screw 1402 is fixed to the frame 1240 by the bracket 1404, movement of the lead screw 1402 results in the simultaneous movement of the frame 1240. The effective length of the adjustable arm 1232 may be increased or decreased as desired to change the angle of inclination of the antenna 100. In moving from the vertical position of FIGS. 18A, 19A and 20A to a tilted position (with the maximum tilted position shown in FIGS. 18D, 19D and 20D) the lead screw 1402 is rotated such that the lead screw 1402 is threaded into the follower 1406 and the frame is extended relative to the bracket to increase the effective length of the adjustable arm 2130. As the lead screw 1402 is threaded into the follower 1406, the movement of the lead screw 1402 increases the effective length of the arm 1230 to move the top of the antenna 100 away from the support 220 and to pivot the antenna 100 to a desired angle of inclination. The slots 1264 on the frame 1240 slide and pivot over the pivot pins 1243 to allow movement of the frame and corresponding pivoting of the antenna as shown in the figures. To adjust the angle of inclination to a more vertical position, the lead screw 1402 is rotated in the reverse direction such that the lead screw 1402 is threaded out of the follower 1406 and the frame 1240 is retracted relative to the bracket 1245 to decrease the effective length of the adjustable arm 2130. As the lead screw 1402 is threaded out of the follower 1406, the movement of the lead screw 1402 decreases the effective length of the arm 1230 to move the top of the antenna toward the support 220 and to pivot the antenna to a desired angle of inclination.

Once the desired angle of inclination is achieved, the lockable pivots 1242 and 1248 are locked such that the frame 1240 is prevented from moving relative to the antenna bracket 114*b* and the bracket 1245 (Block 2104). Specifically, the fasteners 1243 and 1254 are tightened.

The adjustable mount 1230 does not create loose components during the adjustment process. While the lockable pivots are loosened, the threaded bolts and nuts do not need to be completely unthreaded or removed such that there are no loose components to be dropped. In one embodiment, the threaded fasteners may be staked or deformed after the nut is threaded on the bolts to make is impossible to completely unthread the nut from the fastener.

The adjustable mount 1230 also allows the tilting of the antenna 100 to be accomplished easily with one hand. After the lockable pivots are unlocked or loosened, the rotation of the lead screw 1240 using a conventional power driver adjusts the angle of inclination of the antenna 100. Rotating the lead screw 1240 provides precise control of the angle of inclination of the antenna 100. The adjustable mount 1230 can also be released during the adjustment process and the adjustable mount 1230 and antenna will remain in a static position.

Figure 5:
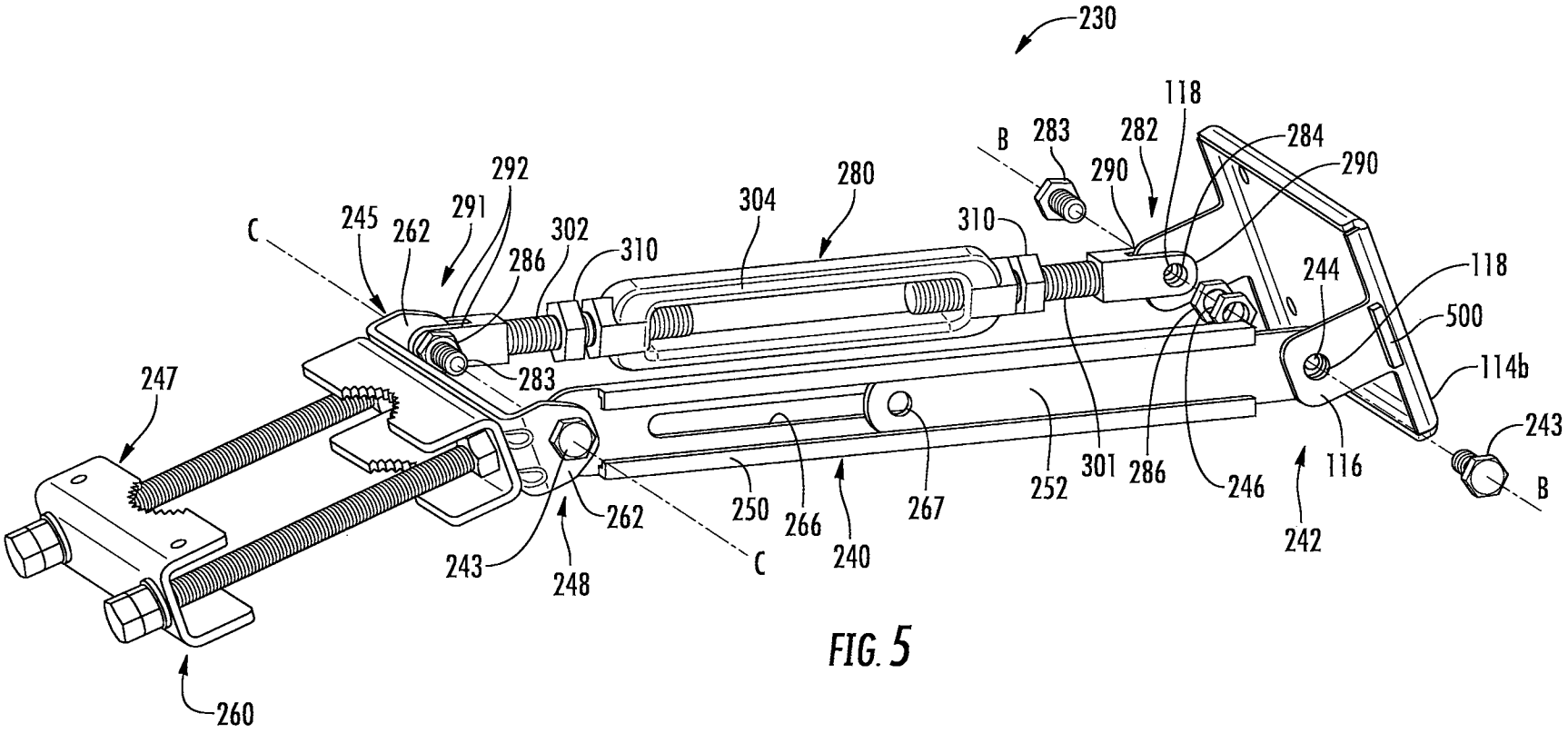
FIG. 5 is a perspective view showing an embodiment of an adjustable antenna mount usable in the mechanical tilt mounting system of FIG. 4.
Figure 6:
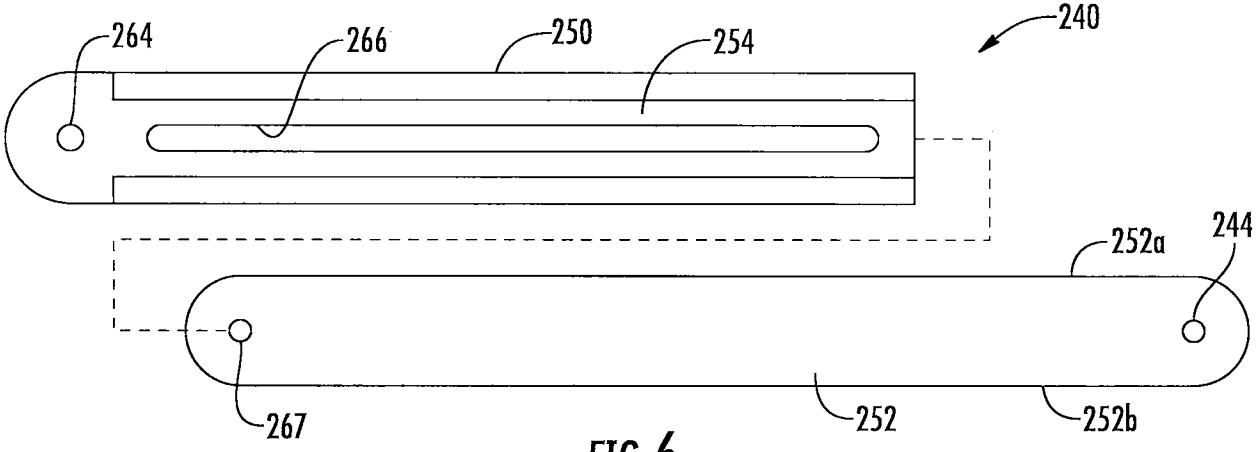
FIG. 6 is a side view of an embodiment of a slide arm used in the adjustable antenna mount of FIG. 5.
Figure 8:
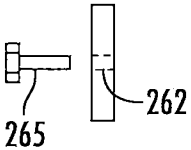
FIG. 8 is an end view of a second arm section of the slide arm of FIG. 6.
Figure 7:
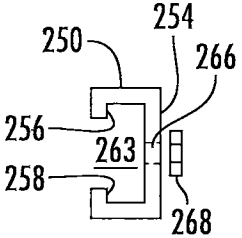
FIG. 7 is an end view of a first arm section of the slide arm of FIG. 6.

In some embodiments, an inclinometer 500 may be provided to measure and provide a manually readable output of the angle of inclination of the antenna. The inclinometer 500 may be a digital inclinometer, bubble inclinometer, tilt gauge or the like. In some embodiments the inclinometer 500 may be mounted on the antenna mount such that it directly measures the angle of inclination of the antenna. For example, as shown in FIG. 5, the inclinometer 500 is mounted on the mounting bracket 114*a* such that it directly measures the angle of the antenna. In other embodiments, the inclinometer 500 may be mounted, for example, on one of the slide arm 240 or control arm 280 to measure the angle of inclination of the arm where the angle of inclination of the arm corresponds to a known angle of inclination of the antenna.

While in some embodiments the antenna mounts may be made of metal, in other embodiments, the antenna mount may reduce passive intermodulation (PIM) when used near base station antennas and/or tower mounted radio frequency (RF) products by eliminating metal-to-metal interfaces. In this regard the antenna mount may be formed of a non-metallic material, such as, for example fiberglass or glass-reinforced resin. In some embodiments, the antenna mount may comprise a hybrid design including structural support elements formed of metal and other elements formed of a non-metallic material. In some embodiments, the antenna mount may be encapsulated with PIM-friendly coating (e.g., a non-conductive material) via a cladding process, deposition, or painting. In some embodiments, an antenna mount kit may comprise ceramic or non-metallic interfaces, such as, for example, non-metallic washers to reduce metal-to-metal contacts near an antenna. Example embodiments of such a construction are shown and described in U.S. Provisional patent Application No. 62/775,524, titled "Devices and Methods For Mitigating External Passive Intermodulation Sources in Base Station Antennas," filed by Kaistha et al. on Dec. 5, 2018, the contents of which is incorporated by reference herein in its entirety.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

The invention claimed is:

1. A mechanical tilt mounting system for a base station antenna, comprising:

an antenna;

a fixed pivot configured to connect the antenna to a support structure at a first location on the support structure, the antenna being rotatable about the fixed pivot to change the angle of inclination of the antenna, the support structure comprising a pole, a tower, or other raised structure;

an adjustable control arm comprising a turnbuckle assembly having a first end connected to the antenna and a second end connected to the support structure at a second location on the support structure that is spaced apart from the first location, wherein the first end of the adjustable control arm comprises a first lockable pivot and the second end of the adjustable control arm comprises a second lockable pivot, and wherein adjustment of the turnbuckle assembly rotates the antenna about the fixed pivot.

2. The mechanical tilt mounting system for a base station antenna according to claim 1, wherein the first lockable pivot and the second lockable pivot each comprise a pivot pin that is secured by a mating member that may be tightened to fix the position of the adjustable control arm relative to the support structure and to the antenna and loosened to allow relative pivoting motion between the adjustable control arm and the support structure and the antenna about the first pivot pin and the second pivot pin.

3. The mechanical tilt mounting system for a base station antenna according to claim 1, wherein the turnbuckle assembly comprises a first threaded member defining the first end and a second threaded member defining the second end, wherein one of the first threaded member and the second threaded member is a left-hand thread and the other one of the first threaded member and the second threaded member is a right-hand thread.

4. The mechanical tilt mounting system for a base station antenna according to claim 3, wherein the first threaded member and the second threaded member threadably engage a frame such that rotation of the frame causes both of the first threaded member and the second threaded member to be simultaneously extended from or retracted into the frame.

5. The mechanical tilt mounting system for a base station antenna according to claim 1, further comprising an expandable and contractable slide arm having a first end connected to the antenna and a second end configured to connect to a support structure, wherein the first end of the slide arm comprises a third lockable pivot and the second end of the slide arm comprises a fourth lockable pivot.

6. The mechanical tilt mounting system for a base station antenna according to claim 5, wherein the slide arm comprises a first arm section and a second arm section, the first arm section and the second arm section being slidably mounted relative to one another such that the position of the first arm section relative to the second arm section is adjustable to set the length of the slide arm and a slide lock for releasably securing the position of the first arm section relative to the second arm section arm section to thereby fix the length of the slide arm.

7. A method of adjusting the mechanical tilt of a base station antenna, comprising:

rotating a frame of a turnbuckle assembly to increase or decrease the length of the turnbuckle assembly to rotate the base station antenna about a fixed pivot axis, the turnbuckle assembly having a first end comprising a first lockable pivot connected to the antenna and a second end comprising a second lockable pivot connected to a pole, a tower, or other raised structure;

locking the position of the turnbuckle assembly relative to the base station antenna comprising locking at least one of the first and second lockable pivots.

8. A mechanical tilt mounting system for a base station antenna, comprising:

an antenna;

a fixed pivot configured to connect the antenna to a support structure, the antenna being rotatable about the fixed pivot to change the angle of inclination of the antenna;

an adjustable mount comprising an adjustable arm having an effective length, the adjustable arm comprising a first member defining a first pivot pivotably connected to the antenna and a second member connected to the support structure that defines a second pivot, the first member being pivotably and translationally connected to the second member at the second pivot; and a linear drive for moving the first member relative to the second member to change the effective length.

9. The mechanical tilt mounting system for a base station antenna according to claim 8, wherein the first member is pivotably connected to the antenna at a first axis of rotation and the second member is pivotably connected to a support structure at a second axis of rotation, the effective length being a distance between the first axis of rotation and the second axis of rotation wherein movement of the first member relative to the second member changes the distance.

10. The mechanical tilt mounting system for a base station antenna according to claim 8, wherein the first member is mounted to the antenna by a first lockable pivot that forms the first axis of rotation and the second member is mounted to the first member by a second lockable pivot that forms the second axis of rotation.

11. The mechanical tilt mounting system for a base station antenna according to claim 10, wherein the linear drive comprises a lead screw that is mounted for rotational movement along its longitudinal axis, wherein the lead screw is fixed to one of the first member or the second member and threadably engages a follower that is secured to the other one of the first member and the second member.

12. The mechanical tilt mounting system for a base station antenna according to claim 11, wherein the first member comprises an elongated slot that receives the second lockable pivot and the lead screw extends parallel to the elongated slot.

13. The mechanical tilt mounting system for a base station antenna according to claim 11, wherein rotation of the lead screw causes the first member to extend away from or retract toward the second member to change the effective length of the adjustable arm.

14. The mechanical tilt mounting system for a base station antenna according to claim 11, wherein the lead screw comprises a connector configured to be engaged by a power driver.

15. The mechanical tilt mounting system for a base station antenna according to claim 10, wherein the first lockable pivot and the second lockable pivot each comprise a pivot pin that is secured by a mating member that may be tightened to fix the position of the first member relative to the antenna and to the second member and loosened to allow relative pivoting motion between the first member and the antenna and the second member.

16. A method of operating a mechanical tilt mounting system for a base station antenna comprising a fixed pivot configured to connect the antenna to a support structure, an adjustable mount comprising an adjustable arm having a first end pivotably connected to the antenna at a first lockable pivot and a second end pivotably connected to a support structure at a second lockable pivot, wherein the adjustable arm comprises a first member defining the first pivot and a second member defining the second pivot where the distance between the first member and the second member defines an effective length of the adjustable arm, the first member being pivotably and translationally connected to the second member, and a linear drive for moving the first member relative to the second member, the method comprising:

unlocking the first lockable pivot;

unlocking the second lockable pivot;

actuating the linear drive to move the first member relative to the second member to change the effective length of the adjustable arm.

17. The method according to claim 16, wherein the linear drive comprises a lead screw and actuating the linear drive comprises engaging the lead screw with a power driver.

* * * * *